US008459741B2

(12) United States Patent
Mazzola et al.

(10) Patent No.: US 8,459,741 B2
(45) Date of Patent: Jun. 11, 2013

(54) CHAIR HAVING LEGS THAT ARE ADJUSTABLE INDEPENDENTLY AND IN A COORDINATED MANNER

(76) Inventors: Paul John Mazzola, Asheville, NC (US); Fred Heys, Weaverville, NC (US)

( * ) Notice: Subject to any disclaimer, the term of this patent is extended or adjusted under 35 U.S.C. 154(b) by 371 days.

(21) Appl. No.: 12/612,213

(22) Filed: Nov. 4, 2009

(65) Prior Publication Data

US 2010/0314914 A1 Dec. 16, 2010

(51) Int. Cl.
*A47C 4/00* (2006.01)
*A47C 1/00* (2006.01)

(52) U.S. Cl.
USPC ..... 297/344.18; 297/16.2; 297/344.12

(58) Field of Classification Search
USPC ..... 297/344.12, 344.18, 440.24, 16.2
See application file for complete search history.

(56) References Cited

U.S. PATENT DOCUMENTS 2,485,111 A * 10/1949 Robins ..... 297/344.14
4,722,570 A * 2/1988 Bertoli ..... 297/344.18
4,772,068 A 9/1988 Gleckler
4,968,092 A * 11/1990 Giambrone ..... 297/151
5,364,163 A 11/1994 Hardison
5,489,138 A * 2/1996 Mariol et al. ..... 297/151
5,494,333 A * 2/1996 Wilson ..... 297/344.18
5,730,066 A 3/1998 Auten et al.
6,056,353 A * 5/2000 Meara ..... 297/41
6,095,607 A * 8/2000 Wenzel ..... 297/344.18
7,121,620 B1 10/2006 Fang
7,334,837 B1 2/2008 Long
7,631,940 B1 * 12/2009 Jager ..... 297/344.18

FOREIGN PATENT DOCUMENTS

GB 2370495 3/2002
WO PCT/US2010054672 5/2011

* cited by examiner

*Primary Examiner* — David Dunn
*Assistant Examiner* — Philip Gabler
(74) *Attorney, Agent, or Firm* — Russell W. Warnock

(57) ABSTRACT

A chair is provided that permits a chair user to configure the chair to accommodate uneven terrain. The chair user manually grasps a strap, additionally grasps the chair at another location, and moves the strap toward the top of the chair. The strap movement releases in a coordinated manner a group of telescoping leg posts from their fixed securement, whereupon the telescoping leg posts individually adjust to respective heights such that a seating portion of the chair is supported at a level disposition.

6 Claims, 24 Drawing Sheets

CHAIR HAVING LEGS THAT ARE ADJUSTABLE INDEPENDENTLY AND IN A COORDINATED MANNER

RELATED APPLICATION

BACKGROUND OF THE INVENTION

This invention relates to an article suitable for placement on uneven surfaces and, in particular, to an article in the form of a folding chair suitable for placement on uneven surfaces. U.S. Pat. No. 6,095,607 to Wenzel notes the desirability of a chair with adjustable-length legs for accommodating the placement of the chair on uneven terrain. U.S. Pat. No. 6,095,607 to Wenzel notes that Wilson U.S. Pat. No. 5,494,333 describes a folding chair for uneven terrain with three adjustable legs and leveling feet and notes that Gleckler U.S. Pat. No. 4,772,068 shows a chair with U-shaped front and back leg members, similar to a beach chair, but with the leg members telescoping and adjustable as to length of extension down from the seat. According to U.S. Pat. No. 6,095,607 to Wenzel, the Gleckler U.S. Pat. No. 4,772,068 chair adjusts to uneven terrain in the forward and back direction, but not side to side.

U.S. Pat. No. 6,095,607 to Wenzel also notes that Hardison U.S. Pat. No. 5,364,163 discloses another example of a chair with adjustable-length legs, the chair having leg members that lock in position using spring-biased locking pins which engage in holes of the telescoping leg members.

U.S. Pat. No. 5,730,066 to Auten et al notes that, in connection with certain outdoor activities such as picnics and camping trips, it is often desirable to set up a table near a vehicle for serving lunch or the like. However, according to U.S. Pat. No. 5,730,066 to Auten et al, it is often difficult to use a conventional table such as a "card table," "picnic table" or folding table for this purpose, as conventional tables are not well suited for use outdoors or on uneven terrain since, for example, conventional tables typically do not have adjustable legs to account for sloping or uneven ground.

Thus, there is a need for improvements for articles such as chairs and tables that can accommodate circumstances in which the surface on which the article is placed is not an even surface such as, for example, an uneven area of terrain. Such an improved article will preferably provide reliable adjustment for adjusting the article to accommodate surfaces of varying degrees of slope while improving the convenience and simplicity of use of the article.

SUMMARY OF THE INVENTION

According to one aspect of the present invention, there is provided a chair. The chair includes a person support structure on which a person can be supported. The chair also includes a first adjustment system having a first telescoping post and a first inter-stop element, and a second adjustment system having a second telescoping post and a second inter-stop element. Each of the first adjustment system and the second adjustment system is connected to the person support structure. The first adjustment system is disposable between a telescoping movement disposition and a stop set disposition. The first telescoping post and the first inter-stop element are movable relative to one another in the telescoping movement disposition. Relative movement between the first telescoping post and the first inter-stop element is resisted when the first telescoping post and the first inter-stop element are in the stop set disposition. The second adjustment system is disposable between a telescoping movement disposition and a stop set disposition. The second telescoping post and the second inter-stop element are movable relative to one another in the telescoping movement disposition. Relative movement between the second telescoping post and the second inter-stop element is resisted when the second telescoping post and the second inter-stop element are in the stop set disposition. The chair also includes a switch over element which is disposable between a staging disposition and a down select disposition. The switch over element is operatively connected to the first adjustment system and the second adjustment system. Disposing the switch over element in its staging disposition effects a respective movement of the first adjustment system from its stop set disposition to its telescoping movement disposition and a respective movement of the second adjustment system from its stop set disposition to its telescoping movement disposition. Disposing the switch over element in its down select disposition effects a respective movement of the first adjustment system out of its telescoping movement disposition into readiness to assume its stop set disposition and a respective movement of the second adjustment system out of its telescoping movement disposition into readiness to assume its stop set disposition. The switch over element is configured such that a predetermined actuation of the switch over element disposes the switch over element in its staging disposition and this predetermined actuation of the switch over element is operable to effect both the respective movement of the first adjustment system from its stop set disposition to its telescoping movement disposition and the respective movement of the second adjustment system from its stop set disposition to its telescoping movement disposition.

According to a feature of the one aspect of the present invention, the chair includes a person support structure having a seating portion on which a person can assume a seated disposition. The first adjustment structure and the second adjustment structure contribute in supporting the seating portion at a spacing above a surface. The first telescoping post is movable relative to the first inter-stop element to vary a height at which the first adjustment structure supports the seating portion above a surface. The second telescoping post is movable relative to the second inter-stop element to vary a height at which the second adjustment structure supports the seating portion above a surface.

According to another feature of the one aspect of the present invention, after the switch over element in its down select disposition has effected a respective movement of the first adjustment system out of its telescoping movement disposition into readiness to assume its stop set disposition and a respective movement of the second adjustment system out of its telescoping movement disposition into readiness to assume its stop set disposition, the first adjustment system and the second adjustment system each automatically move into their respective stop set dispositions upon application of a downward force on the chair.

According to yet another feature of the one aspect of the present invention, in the stop set disposition of the first adjustment structure, the first inter-stop element is operable to engage the first telescoping post at a first set stop location that is at a fixed spacing from the object support portion such that the first inter-stop element and the first telescoping post are releasably secured to one another at the first stop set location. In the telescoping movement disposition, the first inter-stop element is operable to disengage from the first telescoping post to thereby permit movement of the first telescoping post relative to the first set stop location. In the stop set disposition of the second adjustment structure, the second inter-stop element is operable to engage the second telescoping post at a second set stop location that is at a fixed spacing from the object support portion such that the second inter-stop element and the second telescoping post are releasably secured to one another at the second stop set location. In the telescoping movement disposition, the second inter-stop element is operable to disengage from the second telescoping post to thereby permit movement of the second telescoping post relative to the second set stop location.

According to still yet another feature of the one aspect of the present invention, a result of a change of the switch over element between its down select disposition and its staging disposition, the switch over element sequentially shifts the first adjustment structure from its stop set disposition to its telescoping movement disposition and then shifts the second adjustment structure from its stop set disposition to its telescoping movement disposition.

According to another further feature of the one aspect of the present invention, the switch over element includes a cable that engages the first inter-stop element and the second inter-stop element.

According to yet another feature of the one aspect of the present invention, the first adjustment structure includes a first nesting portion. The first telescoping post and the first nesting portion are operatively interconnected to one another such that the first telescoping post can move relative to the first nesting portion. The first inter-stop element includes a first pin component that is movable supported by the first nesting portion and engaged by the cable of the switch over element. The switch over element is operable to effect movement of the first pin component between a pin engagement position in which the first pin component engages the first telescoping post and a pin disengage position in which the first pin component is disengaged from the first telescoping post. The second adjustment structure includes a second nesting portion. The second telescoping post and the second nesting portion are operatively interconnected to one another such that the second telescoping post can move relative to the second nesting portion. The second inter-stop element includes a second pin component that is movable supported by the second nesting portion and engaged by the cable of the switch over element. The switch over element is operable to effect movement of the second pin component between a pin engagement position in which the second pin component engages the second telescoping post and a pin disengage position in which the second pin component is disengaged from the second telescoping post According to still yet another further feature of the one aspect of the present invention, the first pin component is biased towards its pin engagement position and the second pin component is biased towards its pin engagement position in which the first pin component is disengaged from the first telescoping post, and the cable of the switch over element is movable to effect movement of the first pin component and the second pin component in a direction from its respective pin engagement position towards its pin disengagement position against the bias towards its pin engagement position.

According to an additional feature of the one aspect of the present invention, the recipient structure includes a foldable framework that is foldable between an operating position and a non-operating position.

According to another aspect of the present invention, there is provided an article including a recipient structure, a first adjustment system having a first variable set member and a first inter-stop element, and a second adjustment system having a second variable set member and a second inter-stop element. Each of the first adjustment system and the second adjustment system is connected to the recipient structure. The first adjustment system is disposable between an adjusting movement disposition and a stop set disposition. The first variable set member and the first inter-stop element are movable relative to one another in the adjusting movement disposition. Relative movement between the first variable set member and the first inter-stop element is resisted when the first variable set member and the first inter-stop element are in the stop set disposition. The second adjustment system is disposable between an adjusting movement disposition and a stop set disposition. The second variable set member and the second inter-stop element are movable relative to one another in the adjusting movement disposition. Relative movement between the second variable set member and the second inter-stop element is resisted when the second variable set member and the second inter-stop element are in the stop set disposition. A switch over element is also provided. The switch over element is disposable between a staging disposition and a down select disposition. The switch over element is operatively connected to the first adjustment system and the second adjustment system such that disposing the switch over element in its staging disposition effects a respective movement of the first adjustment system from its stop set disposition to its adjusting movement disposition and a respective movement of the second adjustment system from its stop set disposition to its adjusting movement disposition. Disposing the switch over element in its down select disposition effects a respective movement of the first adjustment system out of its adjusting movement disposition into readiness to assume its stop set disposition and a respective movement of the second adjustment system out of its adjusting movement disposition into readiness to assume its stop set disposition.

According to a feature of the another aspect of the present invention, the article includes a recipient structure having an object support portion on which an object can be supported. The first adjustment structure and the second adjustment structure contribute in supporting the object support portion at a spacing above a surface. The first variable set member is movable relative to the first inter-stop element to vary a height at which the first adjustment structure supports the object support portion above a surface. The second variable set member is movable relative to the second inter-stop element to vary a height at which the second adjustment structure supports the object support portion above a surface.

According to another feature of the another aspect of the present invention, after the switch over element in its down select disposition has effected a respective movement of the first adjustment system out of its adjusting movement disposition into readiness to assume its stop set disposition and a respective movement of the second adjustment system out of its adjusting movement disposition into readiness to assume its stop set disposition, the first adjustment system and the second adjustment system each automatically move into their respective stop set dispositions upon application of a downward force on the article.

According to yet another feature of the another aspect of the present invention, in the stop set disposition of the first adjustment structure, the first inter-stop element is operable to engage the first variable set member at a first set stop location that is at a fixed spacing from the object support portion such that the first inter-stop element and the first variable set member are releasably secured to one another at the first stop set location. In the adjusting movement disposition, the first inter-stop element is operable to disengage from the first variable set member to thereby permit movement of the first variable set member relative to the first set stop location. In the stop set disposition of the second adjustment structure, the second inter-stop element is operable to engage the second variable set member at a second set stop location that is at a fixed spacing from the object support portion such that the second inter-stop element and the second variable set member are releasably secured to one another at the second stop set location. In the adjusting movement disposition, the second inter-stop element is operable to disengage from the second variable set member to thereby permit movement of the second variable set member relative to the second set stop location.

According to still yet another feature of the another aspect of the present invention, as a result of a change of the switch over element between its down select disposition and its staging disposition, the switch over element sequentially shifts the first adjustment structure from its stop set disposition to its adjusting movement disposition and then shifts the second adjustment structure from its stop set disposition to its adjusting movement disposition.

According to another further feature of the another aspect of the present invention, the switch over element includes a flexible strand that engages the first inter-stop element and the second inter-stop element.

According to yet another further feature of the another aspect of the present invention, the first adjustment structure includes a first nesting portion. The first variable set member and the first nesting portion are operatively interconnected to one another such that the first variable set member can move relative to the first nesting portion. The first inter-stop element includes a first pin component that is movable supported by the first nesting portion and engaged by the flexible strand of the switch over element. The switch over element is operable to effect movement of the first pin component between a pin engagement position in which the first pin component engages the first variable set member and a pin disengage position in which the first pin component is disengaged from the first variable set member. The second adjustment structure includes a second nesting portion. The second variable set member and the second nesting portion are operatively interconnected to one another such that the second variable set member can move relative to the second nesting portion. The second inter-stop element includes a second pin component that is movable supported by the second nesting portion and engaged by the flexible strand of the switch over element. The switch over element is operable to effect movement of the second pin component between a pin engagement position in which the second pin component engages the second variable set member and a pin disengage position in which the second pin component is disengaged from the second variable set member.

According to still yet another further feature of the another aspect of the present invention, the first pin component is biased toward its pin engagement position and the second pin component is biased toward its pin engagement position in which the first pin component is disengaged from the first variable set member. The flexible strand of the switch over element is movable to effect movement of the first pin component and the second pin component in a direction from its respective pin engagement position towards its pin disengagement position against the bias towards its pin engagement position.

According to an additional feature of the another aspect of the present invention, the recipient structure includes a foldable framework that is foldable between an operating position and a non-operating position.

According to yet another aspect of the present invention, there is provided a method of adjusting the height of a chair relative to a surface on which the chair is supported. The method includes disposing a switch over element in a staging disposition. The switch over element is disposable between the staging disposition and a down select disposition. The switch over element is operatively connected to a first adjustment system, including a first telescoping post and a first inter-stop element, and to a second adjustment system, including a second telescoping post and a second inter-stop element. Each of the first adjustment system and the second adjustment system is connected to a person support structure on which a person can be supported. The first adjustment system is disposable between a telescoping movement disposition and a stop set disposition with the first telescoping post and the first inter-stop element being movable relative to one another in the telescoping movement disposition. Relative movement between the first telescoping post and the first inter-stop element is resisted when the first telescoping post and the first inter-stop element are in the stop set disposition. The second adjustment system is disposable between a telescoping movement disposition and a stop set disposition with the second telescoping post and the second inter-stop element being movable relative to one another in the telescoping movement disposition. Relative movement between the second telescoping post and the second inter-stop element is resisted when the second telescoping post and the second inter-stop element are in the stop set disposition. Disposing the switch over element in its staging disposition effects a respective movement of the first adjustment system from its stop set disposition to its telescoping movement disposition and a respective movement of the second adjustment system from its stop set disposition to its telescoping movement disposition. Disposing the switch over element in its down select disposition effects a respective movement of the first adjustment system out of its telescoping movement disposition into readiness to assume its stop set disposition and a respective movement of the second adjustment system out of its telescoping movement disposition into readiness to assume its stop set disposition. The switch over element is configured such that a predetermined actuation of the switch over element disposes the switch over element in its staging disposition. This predetermined actuation of the switch over element is operable to effect both the respective movement of the first adjustment system from its stop set disposition to its telescoping movement disposition and the respective movement of the second adjustment system from its stop set disposition to its telescoping movement disposition. After disposing the switch over element in its staging disposition, at least one of the first telescoping post relative to the first inter-stop element or the second telescoping post relative to the second inter-stop element is moved. After moving at least one of the first telescoping post relative to the first inter-stop element or the second telescoping post relative to the second inter-stop element, the switch over element is disposed to its down select disposition, thereby effecting a respective movement of the first adjustment system out of its telescoping movement disposition into readiness to assume its stop set disposition and a respective movement of the second adjustment system out of its telescoping movement disposition into readiness to assume its stop set disposition and then disposing the first adjustment system in its stop set disposition and the second adjustment system in its stop set disposition.

BRIEF DESCRIPTION OF THE DRAWINGS

An embodiment of the present invention is now described with reference to the following figures of the drawings:

FIG. 10 is a perspective view of an exemplary embodiment of the article of the present invention in the form of a folding chair, wherein

DETAILED DESCRIPTION OF AN EMBODIMENT

Figure 1:
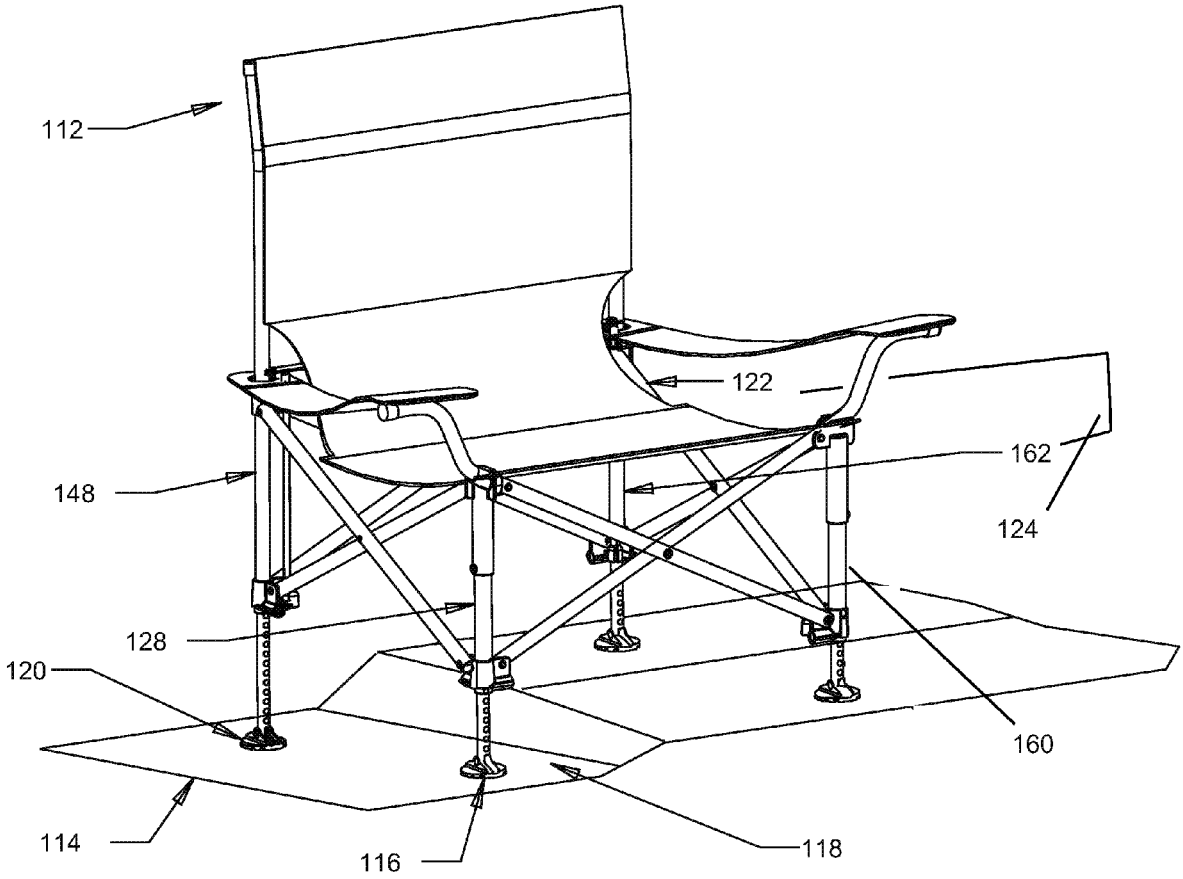
FIG. 1 is a perspective view of one embodiment of the article of the present invention in the form of folding chair.
Figure 2:
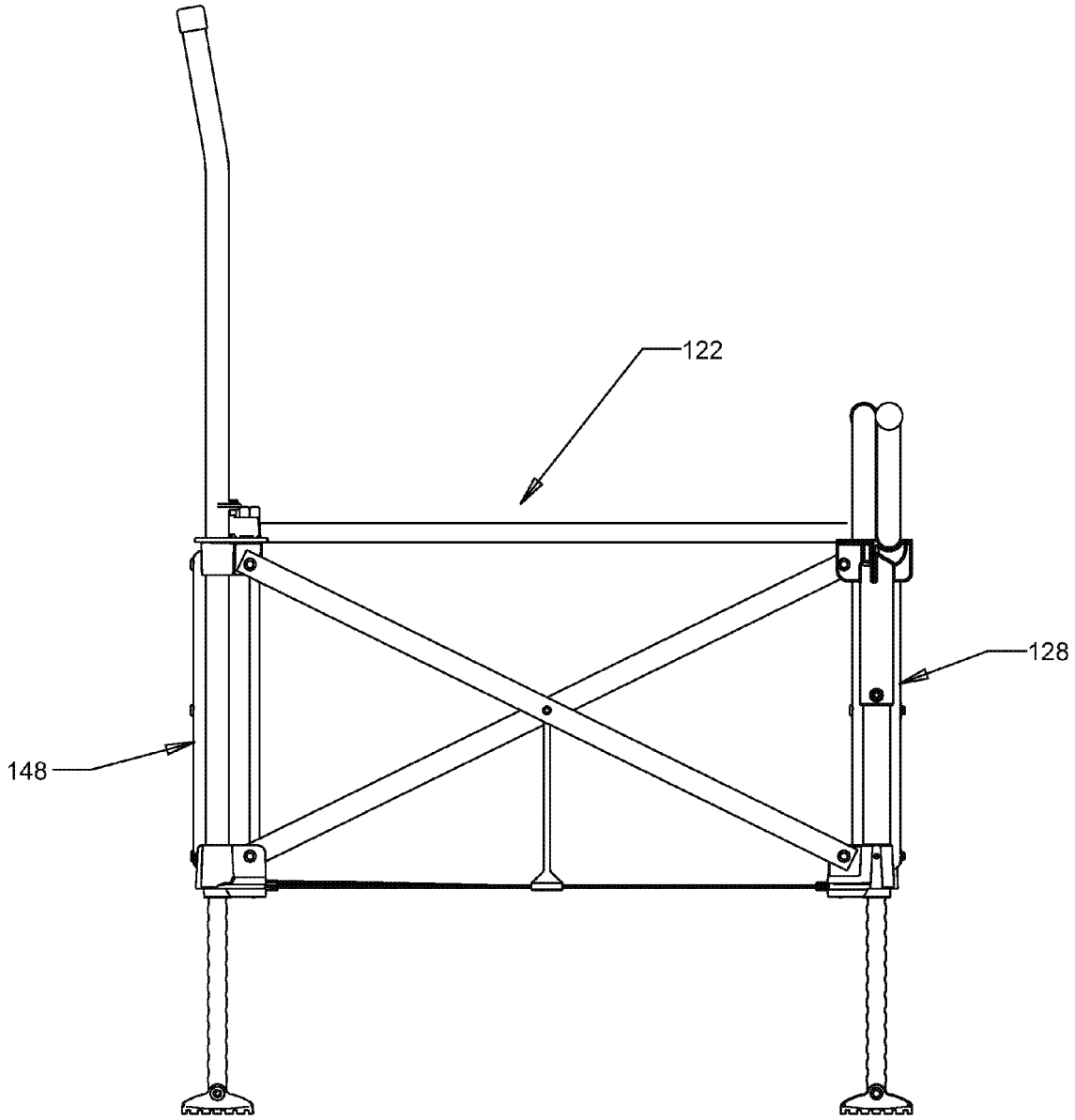
FIG. 2 is a side elevational view of the left hand side of the folding chair shown in FIG. 1.

With reference now to FIGS. 1-12, the present invention relates to an article in the form of a chair. One embodiment of the chair of the present invention will now be discussed with reference to FIGS. 1-9, 11, and 12. An article 110 is configured in the form of a folding chair 112 suitable for placement on uneven surfaces such as, for example, a terrain location 114 having a raised portion 116 at a higher elevation than a horizontal plane 118 and a lower portion 120 having a lower elevation than the horizontal plane 118. The folding chair 112 is advantageously adjustable to the terrain location 114 such that, when the folding chair is placed on the terrain location 114, a seating surface 122 of the folding chair is substantially level—that is, a seating plane 124 delimited by the seating surface 122 is substantially parallel to the horizontal plane 118.

The folding chair 112 includes a recipient structure 126 that includes the seating surface 122. The folding chair 112 also includes a first adjustment system 128 in the form of a first pin 130 and the first adjustment system 128 includes a first variable set member 132 in the form of a respective one of four legs 134 having a nesting portion 136 and an adjustable portion in the form of telescoping post 138. The first variable set member also includes a foot base 140 formed at one end of the telescoping post 138. The first adjustment system 128 includes a first inter-stop element 142 in the form of an adjustment block 144 that houses a release pin 146.

Figure 14:
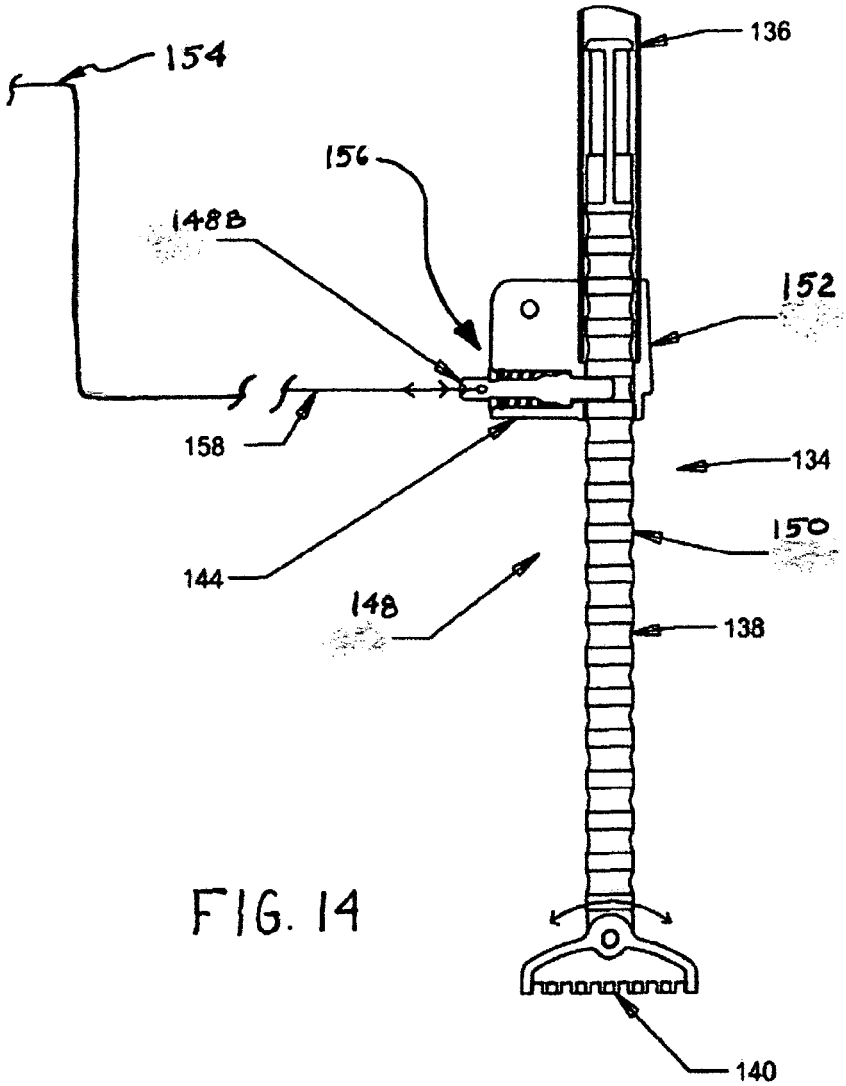
FIG. 14 is a sectional view of the second adjustment structure of the folding chair shown in FIG. 1.

Continuing further with the components of the article 110, reference is still had to FIGS. 1-12 and, additionally, reference is had to FIG. 14, which is a sectional view of the second adjustment structure of the folding chair shown in FIG. 1. The folding chair 112 includes a second adjustment system 148 that includes a second variable set member 150 and a second inter-stop element 152. The first adjustment structure 128 and the second adjustment structure 148 are each connected to the recipient structure 126, the first adjustment structure 128 being disposable between an adjusting movement disposition and a stop set disposition with the first variable set member 132 and the first inter-stop element 142 being movable relative to one another in the adjusting movement disposition and relative movement between the first variable set member 132 and the first inter-stop element 142 being resisted when the first variable set member 132 and the first inter-stop element 142 are in the stop set disposition. The second adjustment structure 148 is disposable between an adjusting movement disposition and a stop set disposition with the second variable set member 150 and the second inter-stop element 152 being moveable relative to one another in the adjusting movement disposition and relative movement between the second variable set member 150 and the second inter-stop element 152 being resisted when the second variable set member 150 and the second inter-stop element 152 are in the stop set disposition.

The article 110 also includes a switchover element 154 in the form of a pin assembly 156 and a cable sub-assembly 158 operable to selectively release the release pin 146 associated with each one of the first adjustment system 128 and the second adjustment system 148. The switchover element 154 is disposable between a staging disposition and a down select disposition. The switchover element 154 is operatively connected to the first adjustment structure 128 and the second adjustment structure 148 such that disposing the switchover element 154 in its staging disposition effects a respective movement of the first adjustment structure 128 from its stop set disposition to its adjusting movement disposition and a respective movement of the second adjustment structure 148 from its stop set disposition to its adjusting movement disposition. Disposing the switchover element 154 in its down select disposition effects a respective movement of the first adjustment system 128 out its adjusting movement disposition into readiness to assume its stop set disposition and a respective movement of the second adjustment structure 148 out of its adjusting movement disposition into readiness to assume its stop set disposition. The switch over element 154 is configured such that a predetermined actuation of the switch over element disposes the switch over element in its staging disposition and this predetermined actuation of the switch over element is operable to effect both the respective movement of the first adjustment system from its stop set disposition to its adjusting movement disposition and the respective movement of the second adjustment system from its stop set disposition to its adjusting movement disposition.

Figure 10A:
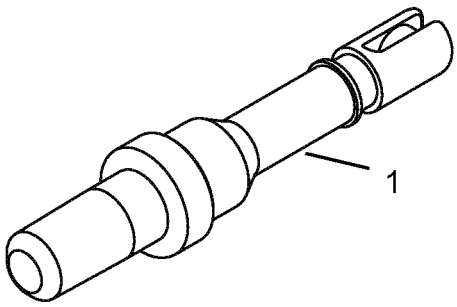
FIG. 10*a* shows a perspective view of an exemplary embodiment of the release pin.
Figure 10B:
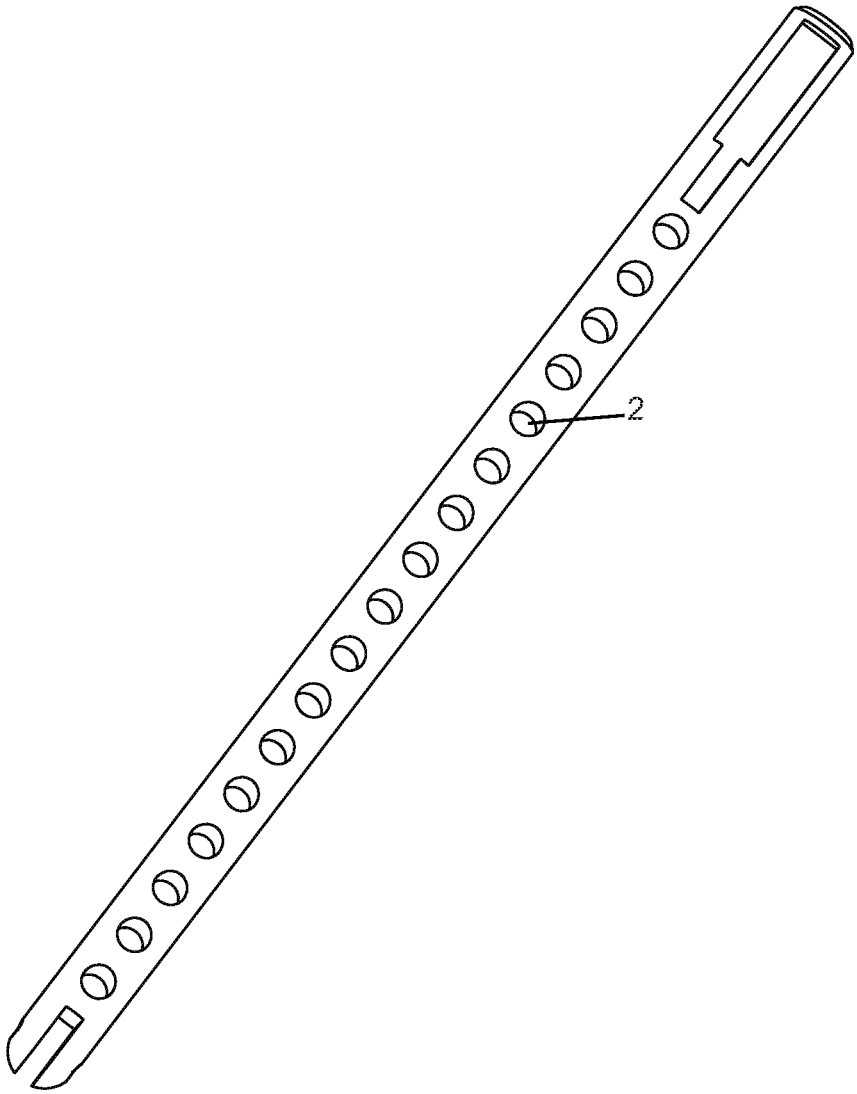
FIG. 10*b* shows a perspective view of the adjustable leg.
Figure 10C:
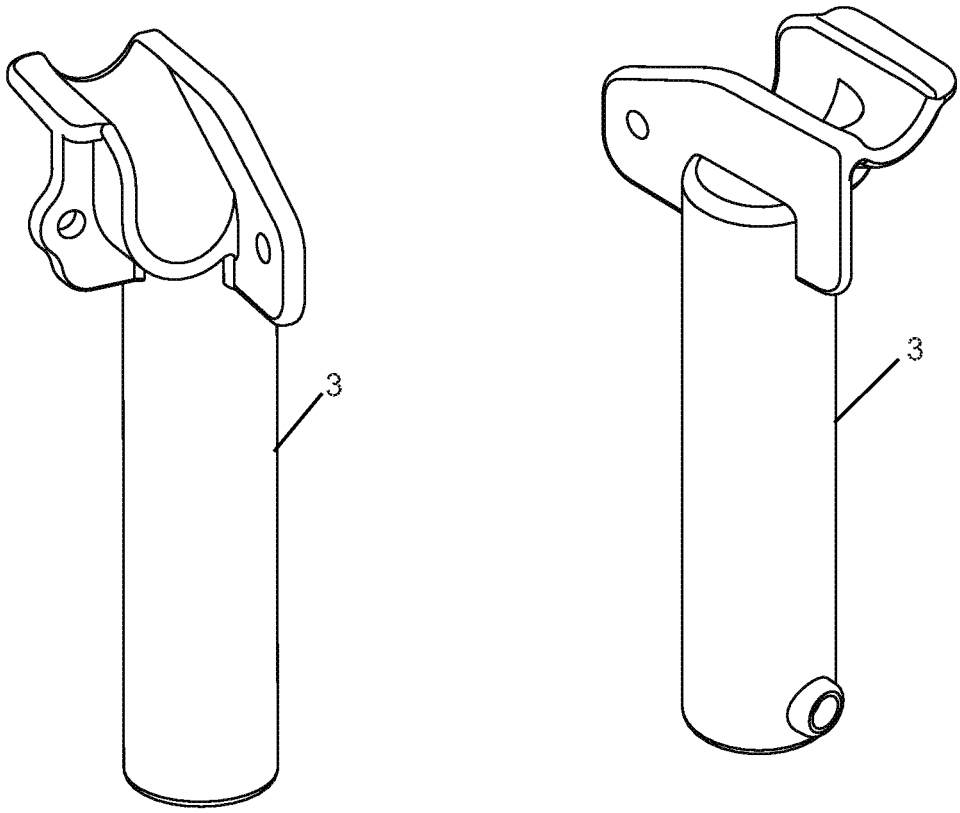
FIG. 10*c* shows a perspective view of the front right joint.
Figure 10D:
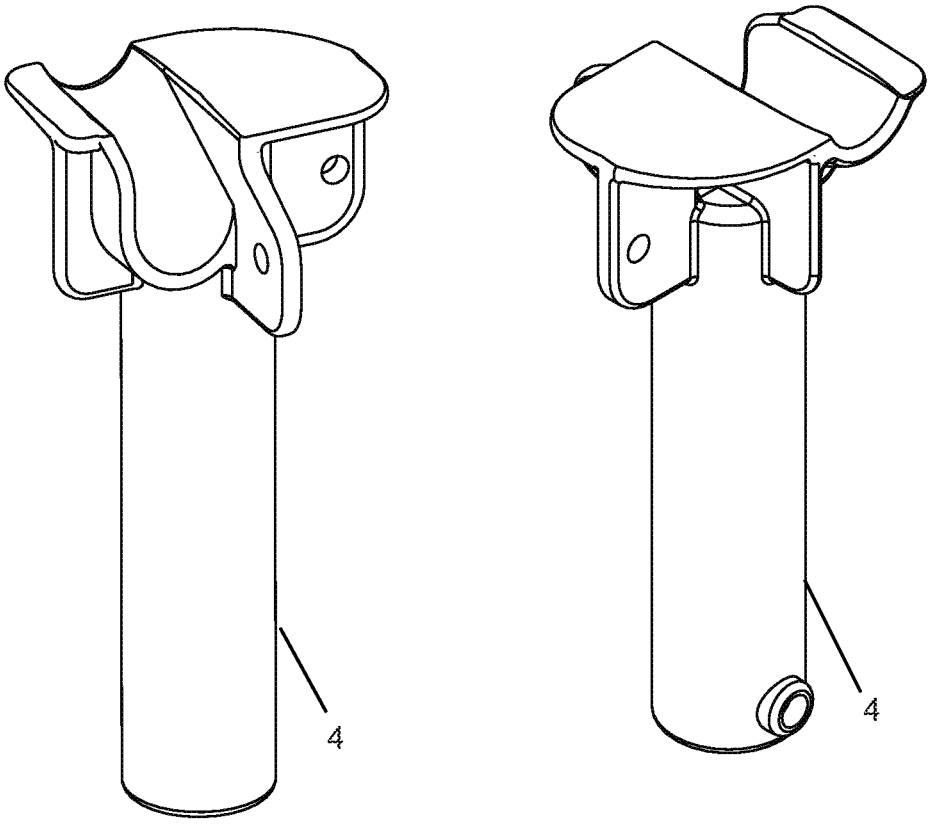
FIG. 10*d* shows perspective views of the left front joint.
Figure 10E:
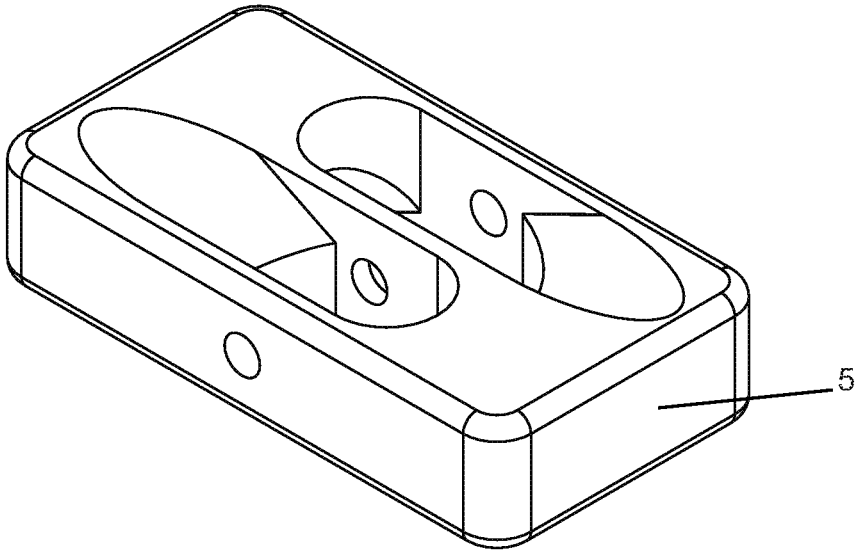
FIG. 10*e* shows a perspective view of the front block.
Figure 10F:
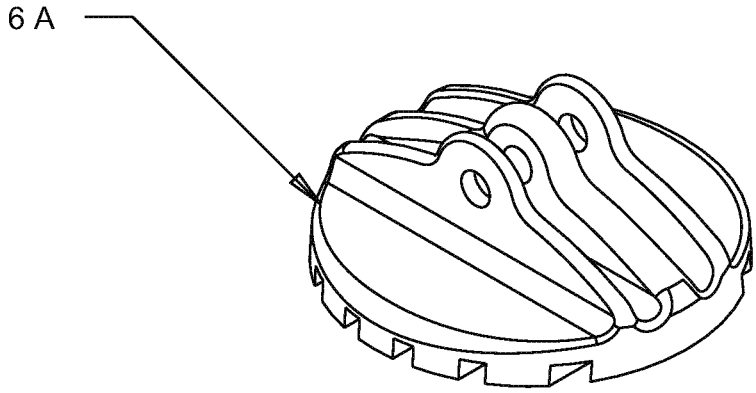
FIG. 10*f* shows an exploded view of the foot base assembly.
Figure 10G:
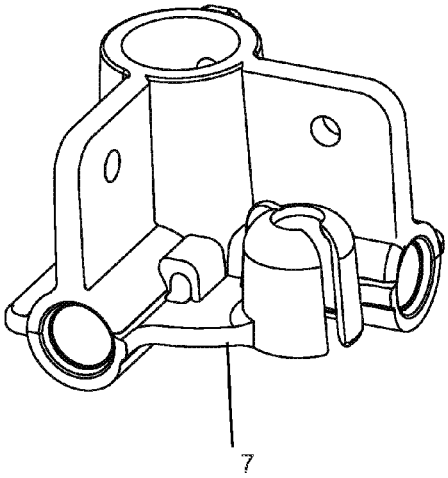
FIG. 10*g* shows perspective views of the adjustment block.
Figure 10G:
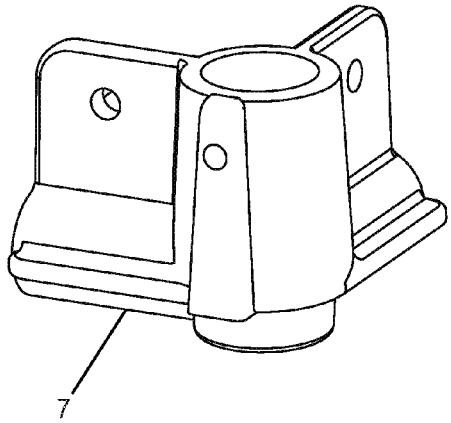
Figure 10H:
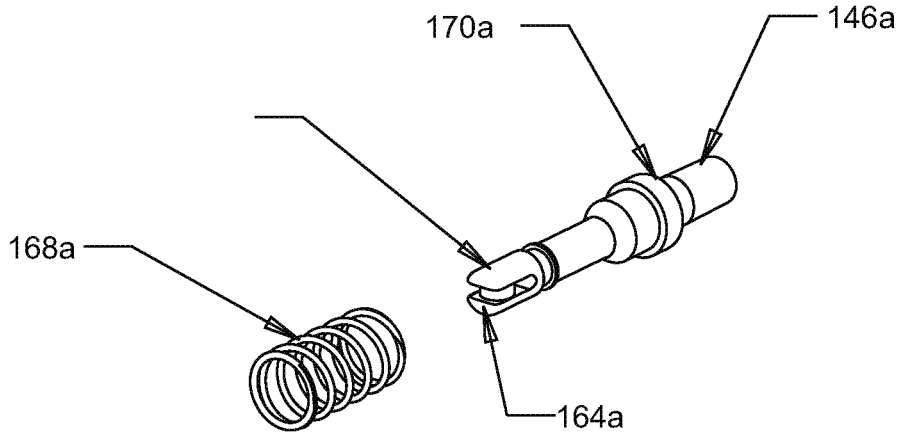
FIG. 10*h* shows a perspective view of the pin assembly.
Figure 10I:
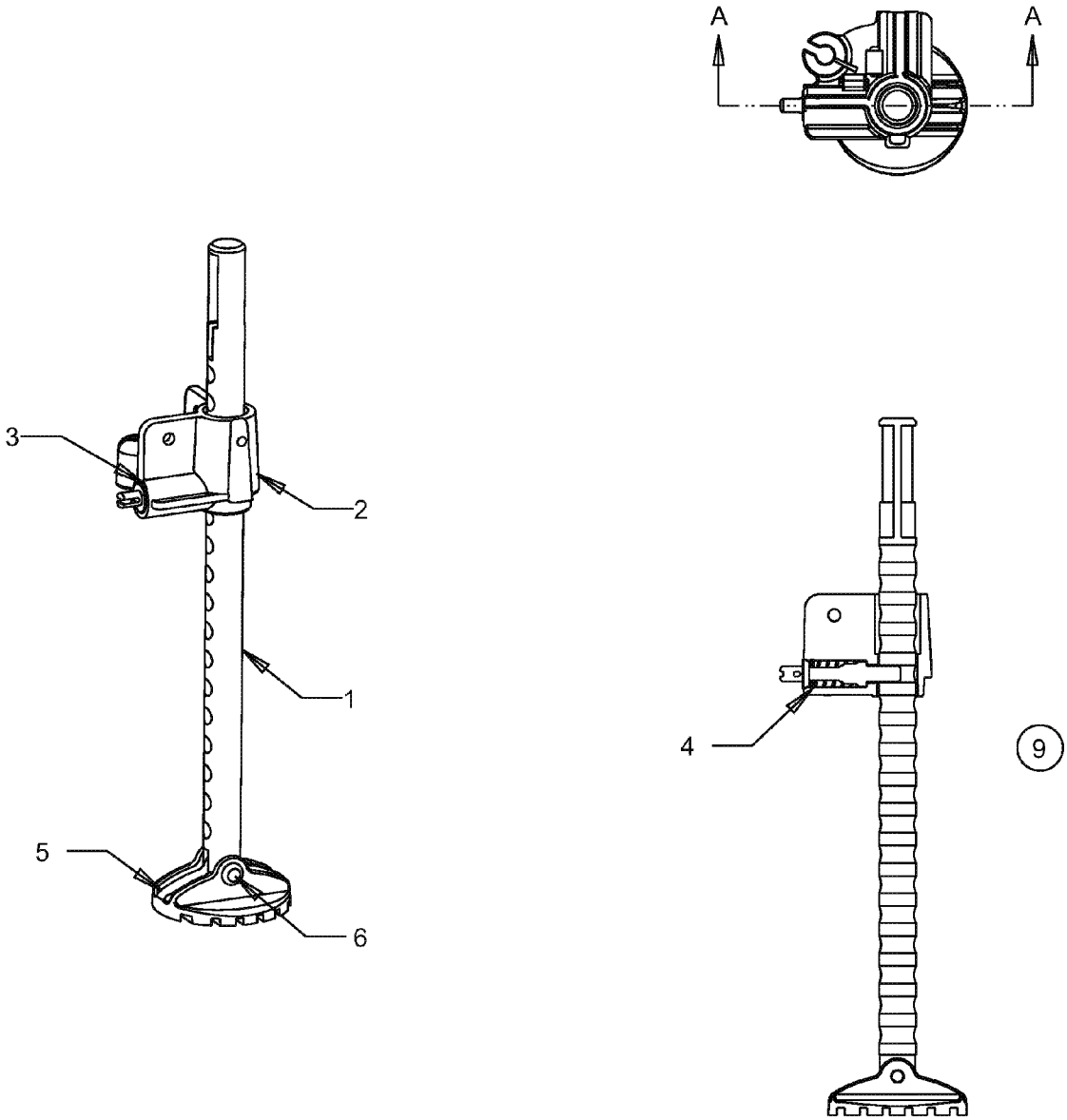
FIG. 10*i* shows a perspective view of the adjustable leg assembly.
Figure 10J:
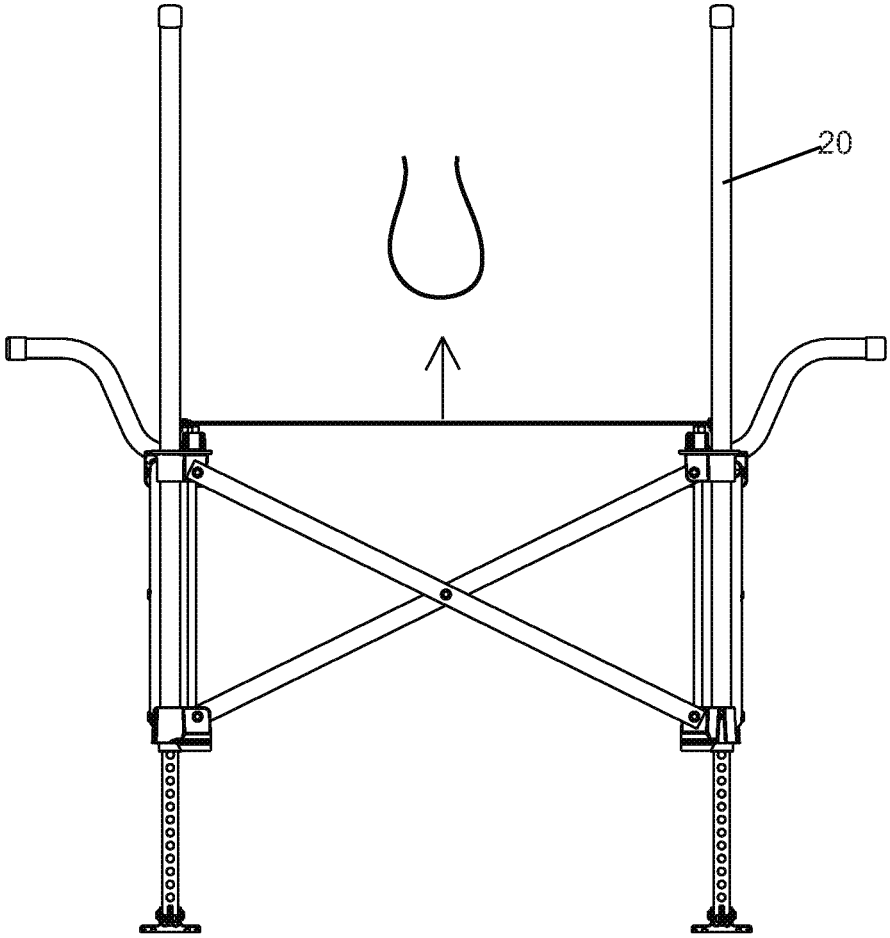
FIG. 10*j* shows back and side views of the cable.
Figure 10K:
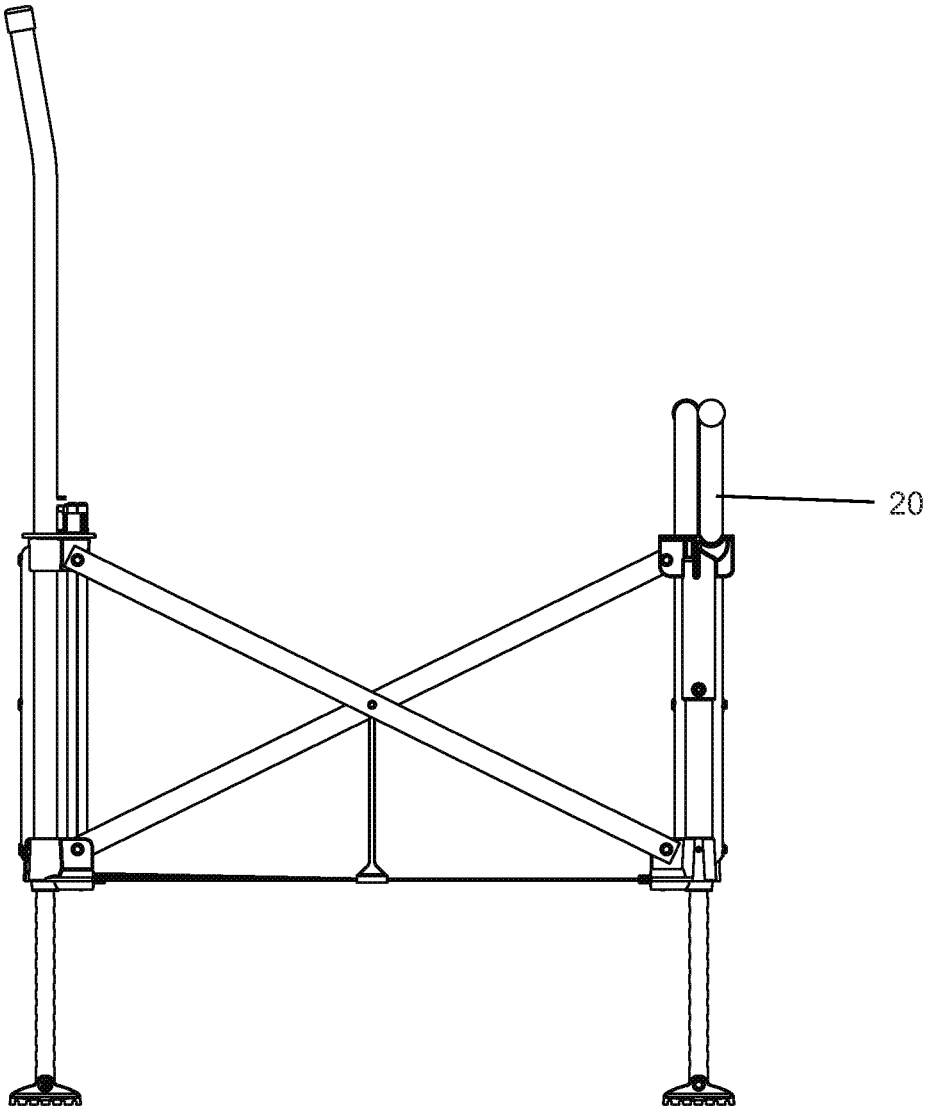
FIG. 10*k* shows a side view of the handle.
Figure 11:
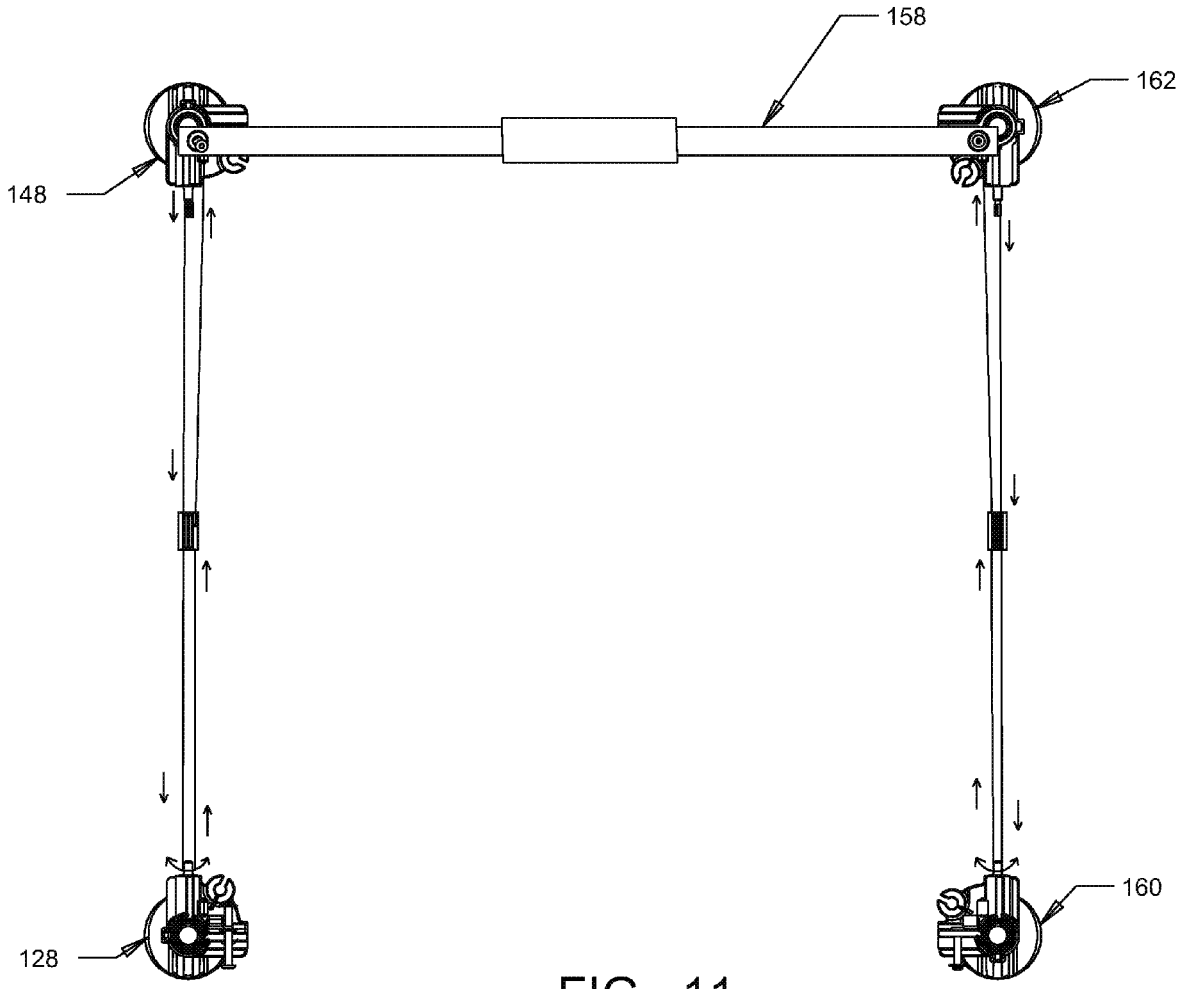
FIG. 11 is a top schematic view of the cable sub-assembly of the folding chair shown in FIG. 1.

Reference is now had to FIG. 10*h*, which is in an enlarged prospective view of the release pin 146*a*, it being understood that each of the other release pins 146*b*, 146*c*, and 146*d* are similarly configured. As seen in FIG. 10*h*, the release pin

146*a* includes a change of direction roller 164*a* which is rotatably mounted on a longitudinal extent of the release pin via an axial pin 166*a*. A spring 168*a* is inserted over a portion of the longitudinal extent of the release pin at an axial end of the spring 168*a* opposite to its axial end that faces toward the change of direction roller 164*a* and abuts a collar ring 170 formed on the longitudinal extent of the release pin.

Figure 12:
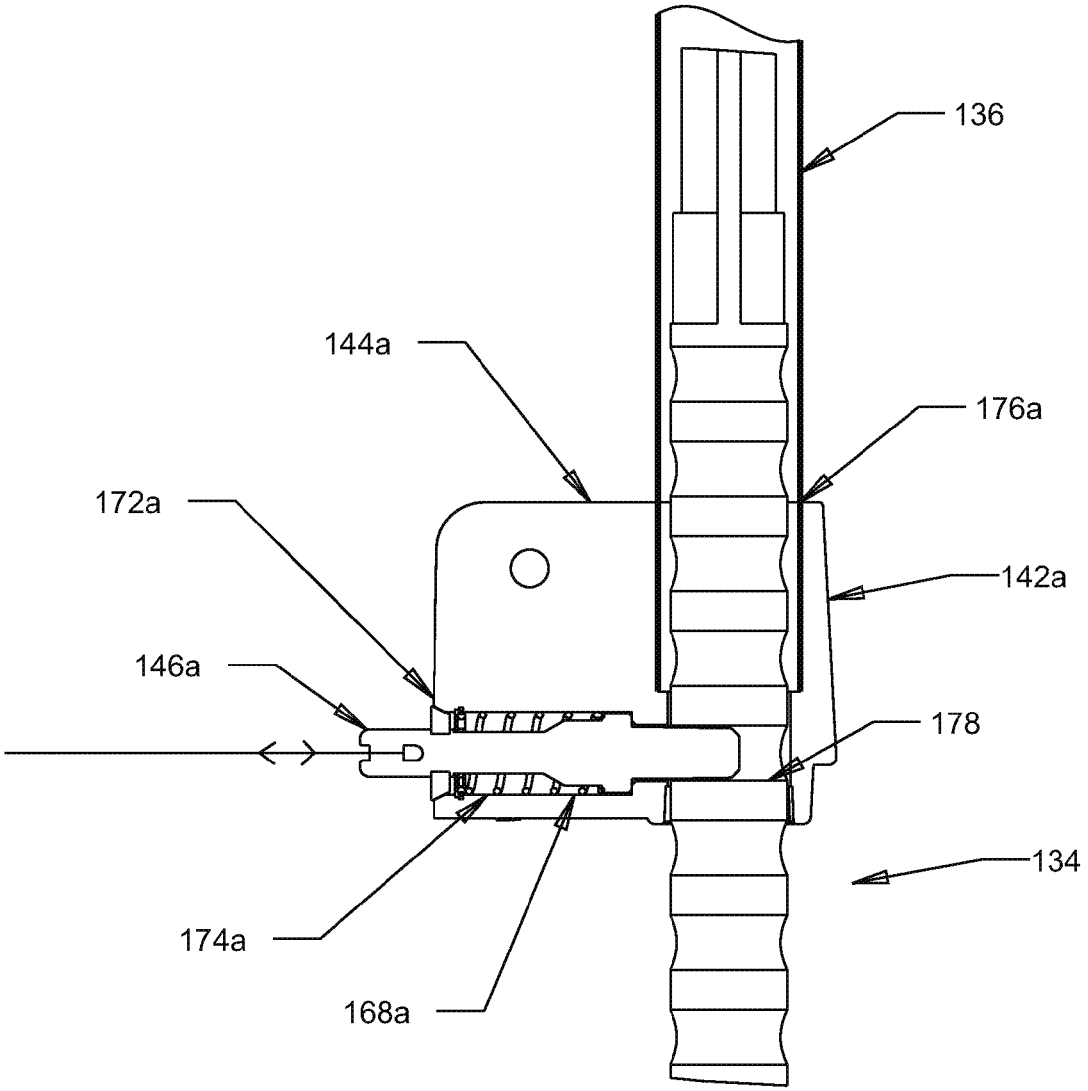
FIG. 12 is an enlarged sectional view of the first adjustment structure of the folding chair shown in FIG. 1.

With reference now to FIG. 12, which is an enlarged sectional view of the adjustment block 144*a*, it can be seen that the release pin 146*a* is movably retained in a bore 172*a* of the adjustment block such that the release pin 146*a* is movable axially along the axis of its longitudinal extent. The approximate axial end of the spring 168*a* abuts a stop shoulder 174*a* formed on the inter diameter of the bore 172*a*. The longitudinal extent of the release pin 146*a* extending axially beyond the collar 170*a* is dimensioned such that this longitudinal extent portion can be selectively extended into, and retracted from, a through bore 178 formed in the telescoping post 138*a* of the first adjustment system 128.

The leg 134 is movably mounted in a vertical bore 176*a* formed in the adjustment block 144*a* in a manner that permits the leg 134*a* to move relative to the adjustment block 144*a*.

Figure 3:
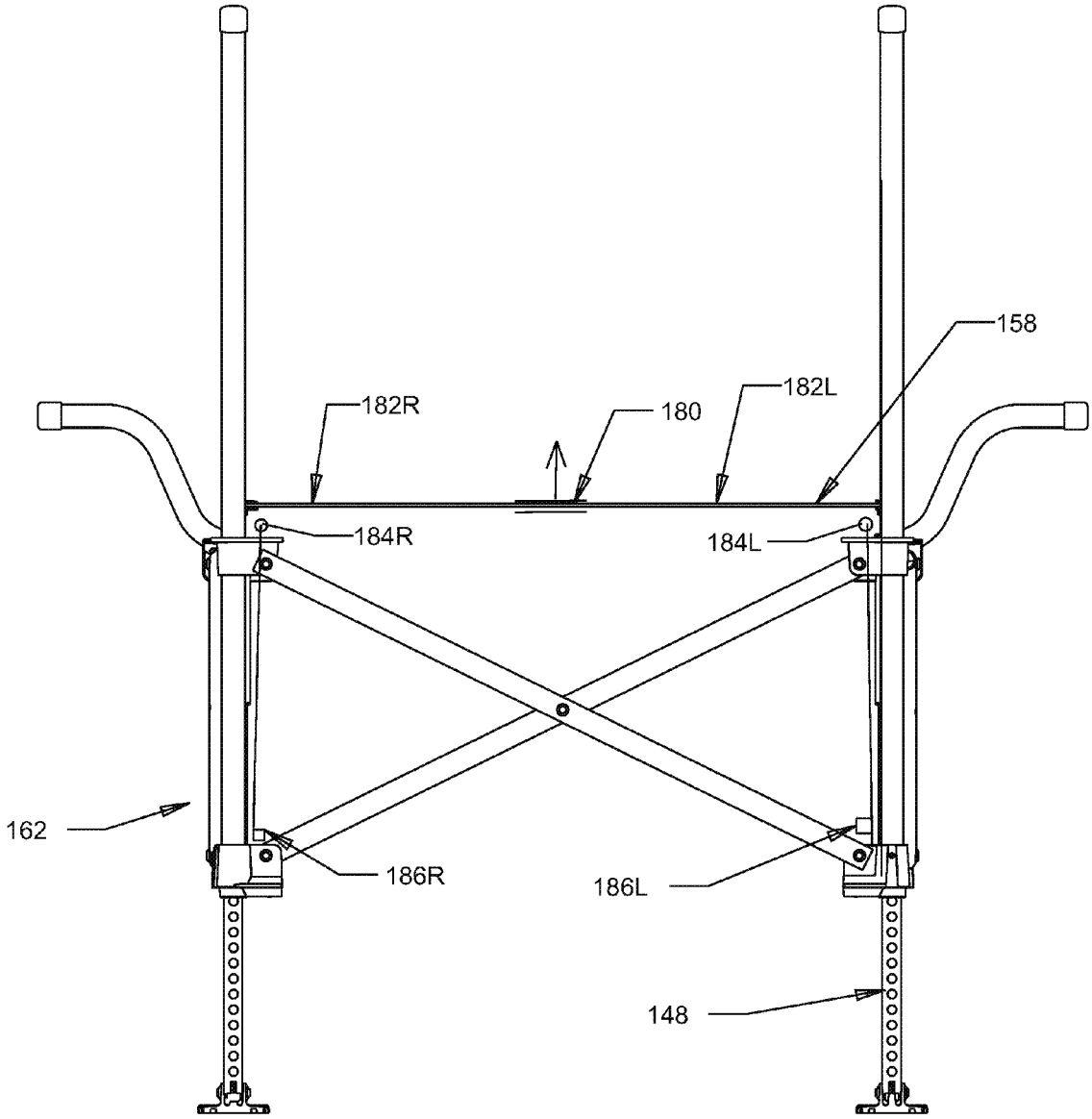
FIG. 3 is a rear elevational view of the back of the folding chair shown in FIG. 1.
Figure 4:
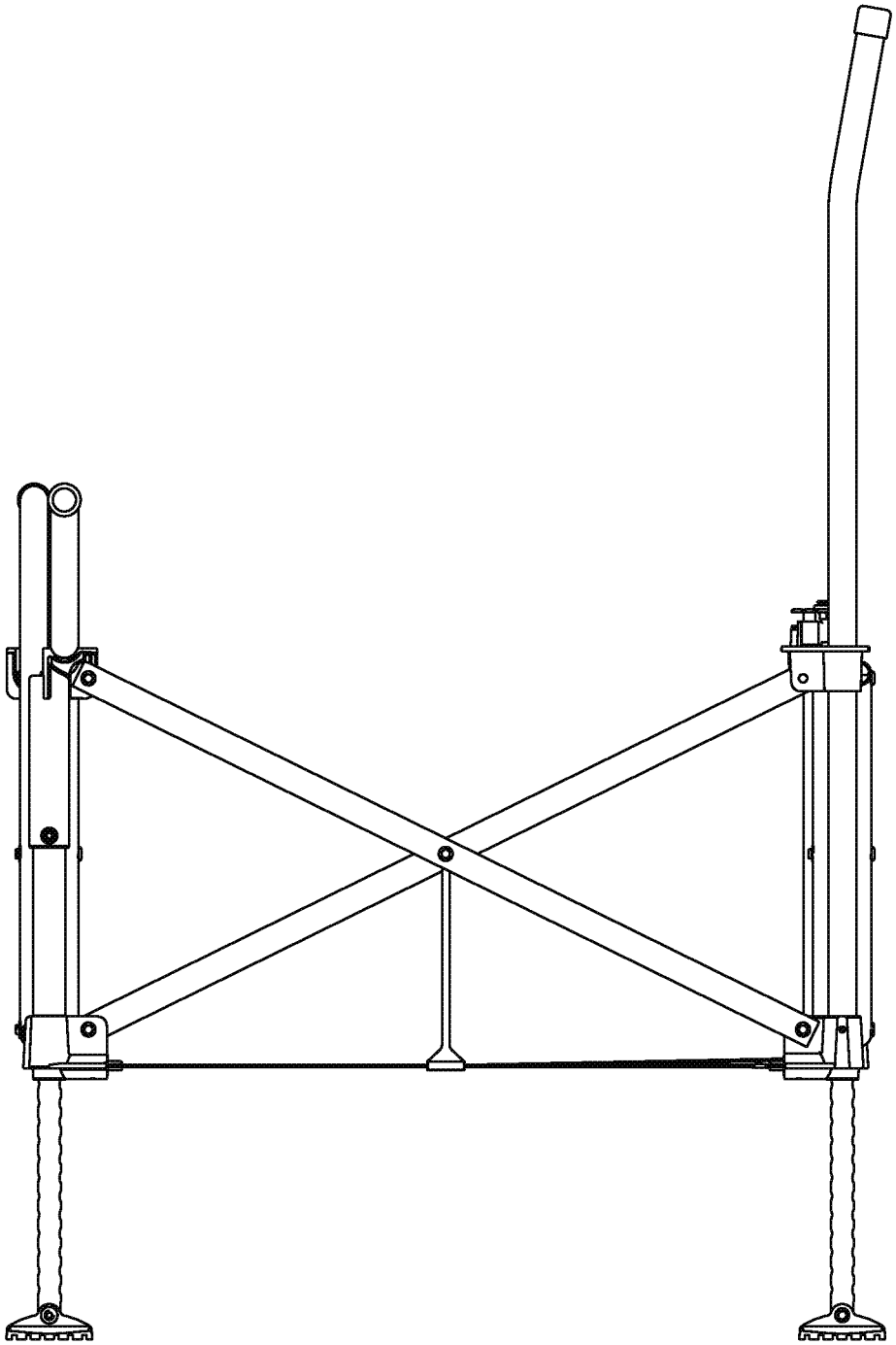
FIG. 4 is a side elevational view of the right hand side of the folding chair shown in FIG. 1.
Figure 5:
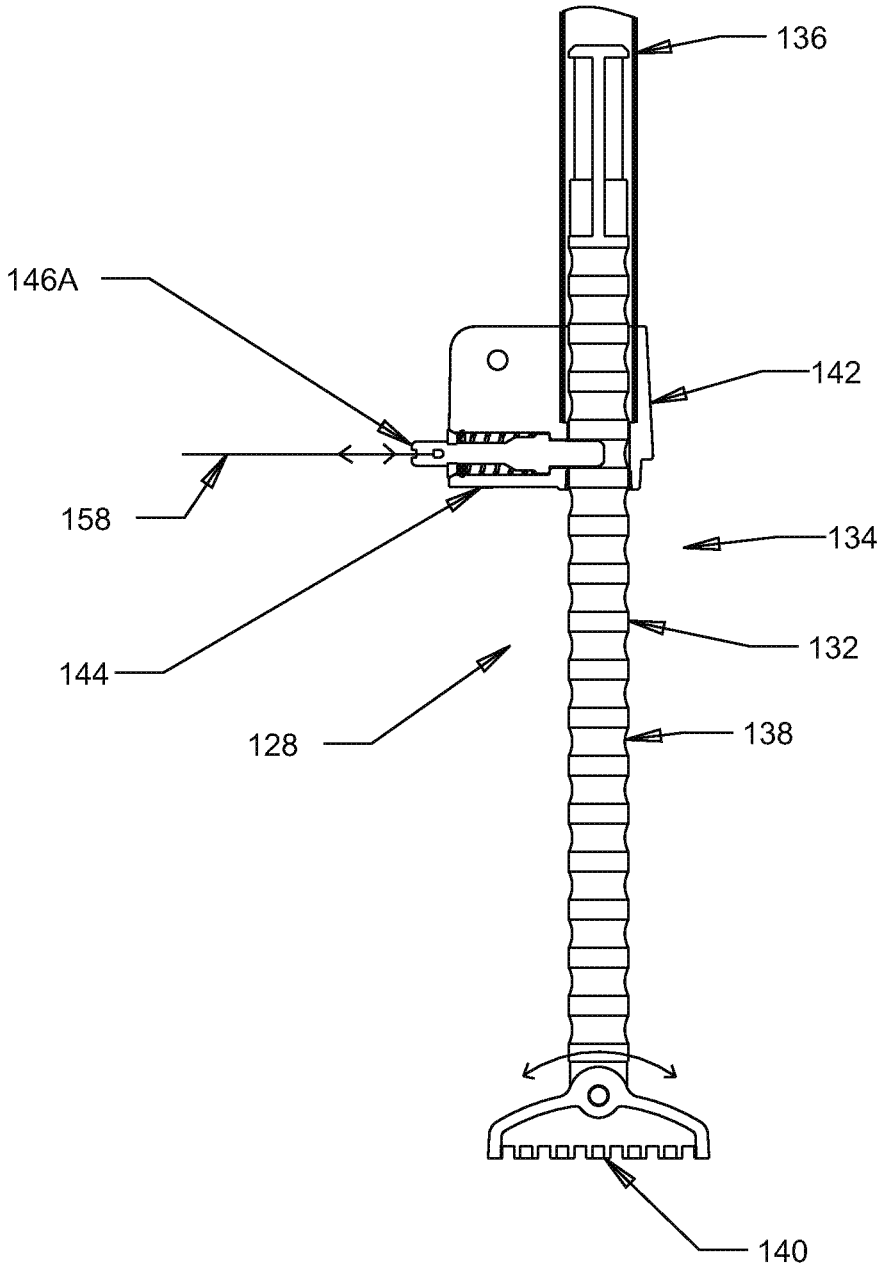
FIG. 5 is a sectional view of the first adjustment structure of the folding chair shown in FIG. 1.
Figure 6A:
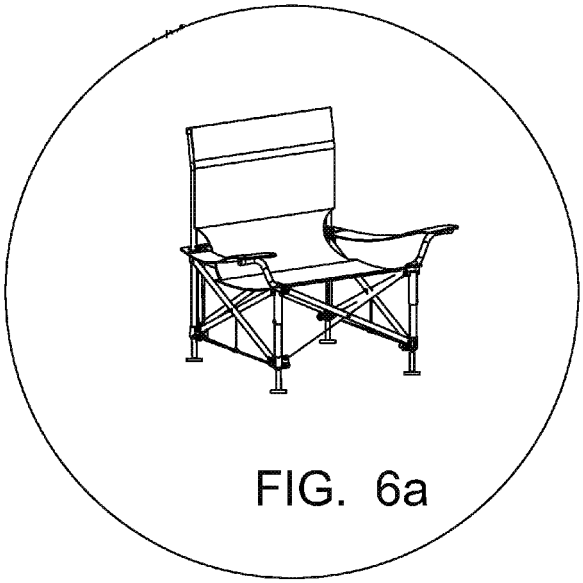
FIG. 6 is a perspective view of the first adjustment structure and the second adjustment structure of the folding chair shown in FIG. 1 and showing the switch over element in its down select disposition.
Figure 6:
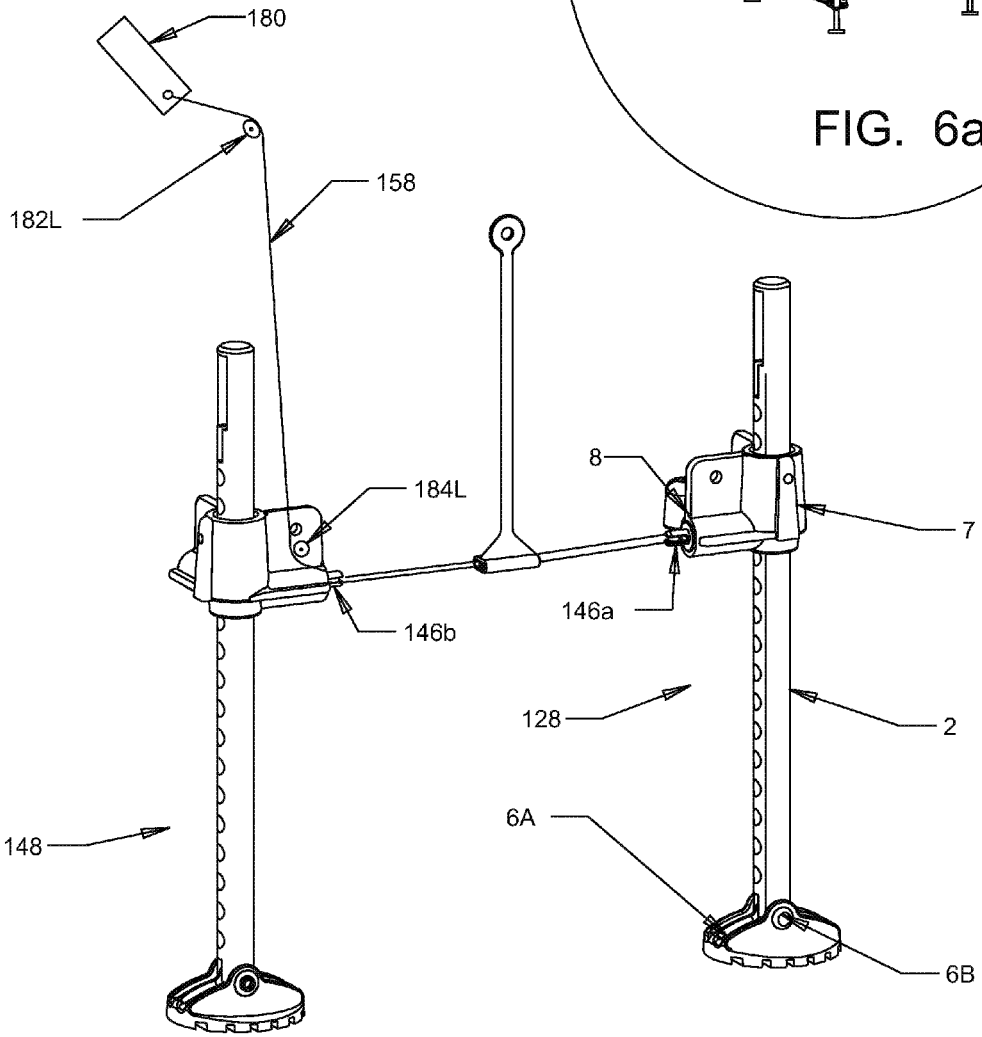

With reference now to FIG. 3, which is an elevational rear view of the folding chair 112, the cable sub-assembly 158 includes a strap 180 positioned generally centrally at the rear of the folding chair 112. A right hand cable 182R is connected to a right hand side of the strap 180 and extends around and to the release pins 144*c*, 144*d* mounted on the third adjustment structure 160 and the fourth adjustment structure 162, respectively. A left hand cable extent 182L is connected to the left hand side of the strap 180 and extends to and around the release pins 146*a*, 146*b* on the first adjustment structure 128 and the second adjustment structure 148, respectively. As seen in FIG. 3, the left hand cable extent 182L is trained around a change of direction roller 184L as it extends generally horizontally away from the strap 180, thereafter descends vertically after passing over the change of direction roller 184L to a change of direction roller 186L around which the cable extent is also trained. With reference now to FIG. 6, which is an enlarged prospective view of the first adjustment structure 128 and the second adjustment structure 148, it can be seen that the left hand cable extent 182L extends generally horizontally after travel around the change of direction roller 186L along a path to the release pin 146*a*, is trained around the change of direction roller 164*a* on the release pin 146*a*, and extends thereafter generally horizontally to the release pin 146*b*. The end of the left hand cable extent 182L is secured to the release pin 146*b* of the second adjustment structure 148.

With reference to FIG. 3, it can be seen that the right hand cable extent extends generally horizontally from the strap 180, is trained around a change of direction roller 184R, descends generally vertically to a change of direction roller 186R, is trained there around, extends to the release pin 146*c* of the third adjustment structure 160, and extends therefrom to the release pin 146*d* of the forth adjustment structure 162.

With reference now to FIGS. 6-9, an operation of the folding chair 112 will now be described in which the folding chair 112 is adjusted to permit the chair to accommodate a surface having surface features at differing heights. As seen in FIG. 6, in the down select disposition of the switchover element 154, the release pin 146*a* is disposed in the bore 172*a* of the adjustment block 144*a* such that the longitudinal end portion of the release pin extends into a given through bore 178 of the telescoping post 138A. Likewise, the release pin 146*b* is disposed such that it's longitudinal end portion extends into a respective through bore 178 of the telescoping post 138*b*. In this down select disposition of the switchover element 154 all of the respective telescoping posts 138*a*, 138*b*, 138*c*, and 138*d* are reliably secured by their associated release pins relative to the respective adjustment blocks 144*a-d* such that all of the telescoping posts 138*a-d* are secured in a fixed position relative to their respective nesting portions 136*a-d*.

Figure 7:
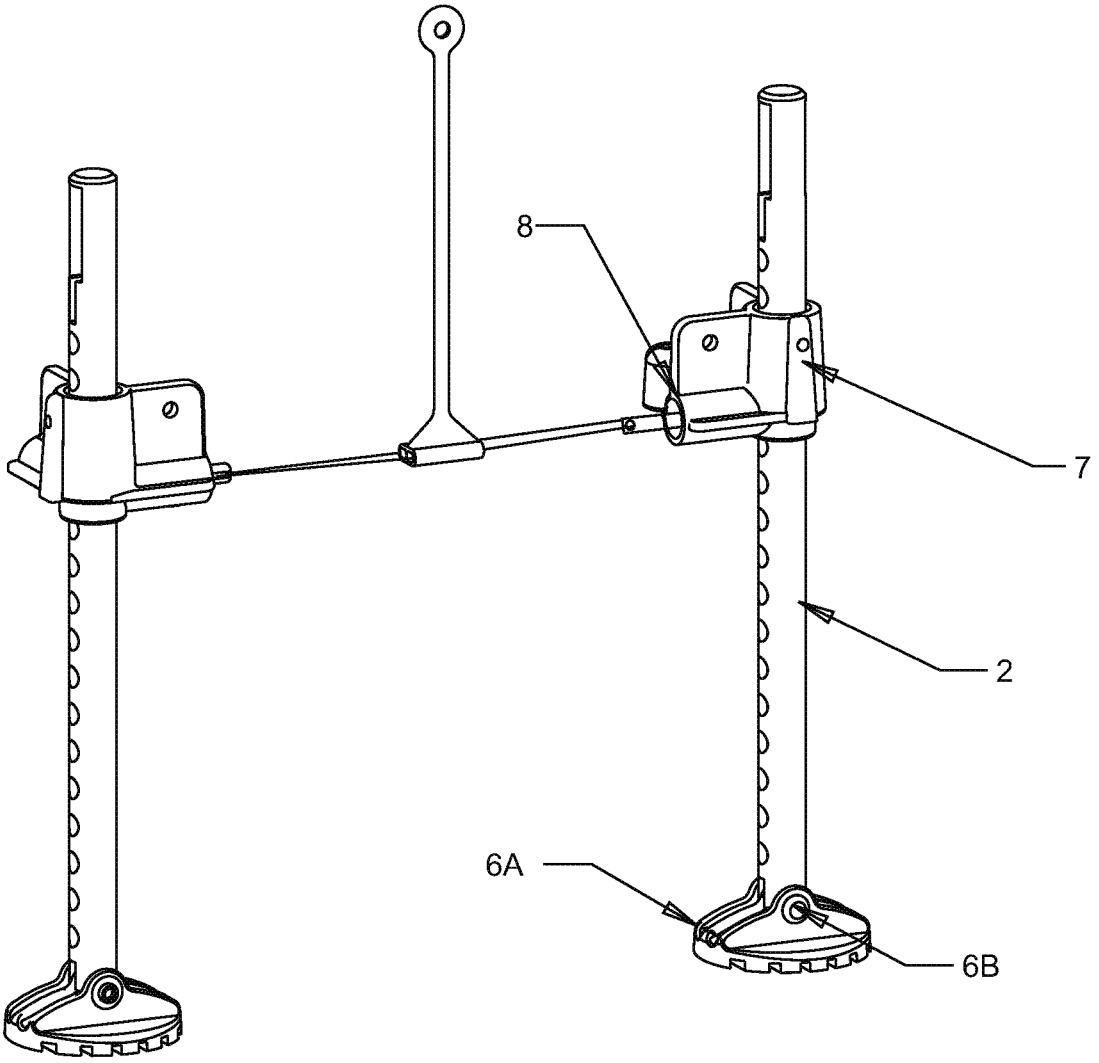
FIG. 7 is a perspective view of the first adjustment structure and the second adjustment structure of the folding chair shown in FIG. 1 and showing the switch over element in an initial period of its staging disposition.

Turning now to FIG. 7, when a chair user desires to configure the folding chair 112 to accommodate uneven terrain such as, for example, the terrain location 114, the chair user manually grasps the strap 180 and additionally grasps the folding chair 112 at a location other than the strap 180. The chair user, while both grasping the other portion of the folding chair and the strap 180, moves the strap 180 such that the strap is raised relatively toward the top of the folding chair. During an initial period of this movement, the left hand cable extent 182L is pulled via the movement of the strap 180 and this effects a movement of the left hand cable extent 182L such that the cable extent moves around the change of direction roller 164*a* on the release pin 146*a*. During this initial period of movement, the release pin 146*b* on the second adjustment structure 148 resists the pulling tension exerted thereon by the end of the left hand cable extent 182L, whereupon the movement of the left hand cable extent 182L effects a retracting movement of the release pin 146*a* from its seated disposition in the given through bore 178 telescoping post 138*a*. This movement of the release pin 146*a* is of a magnitude that the collar 178*a* of the release pin 146*a* exerts an axial force on the spring 168*a* while, at the same time, the stop shoulder 174*a* of the adjustment block 144*a* engages the opposite axial end of the spring 168*a*, whereupon the spring 168*a* is compressed.

Figure 8:
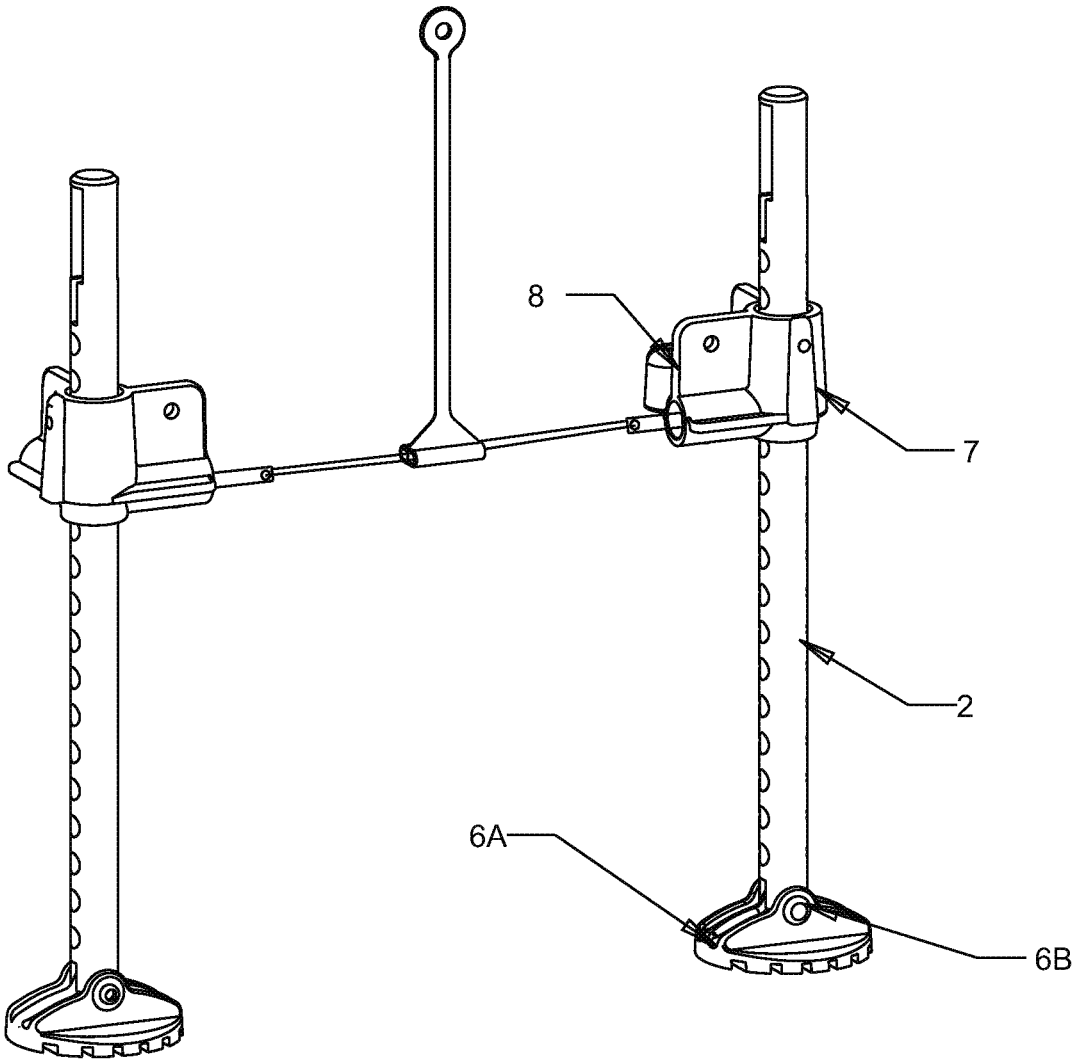
FIG. 8 is a perspective view of the first adjustment structure and the second adjustment structure of the folding chair shown in FIG. 1 and showing the switch over element in a subsequent period of its staging disposition.
Figure 10:
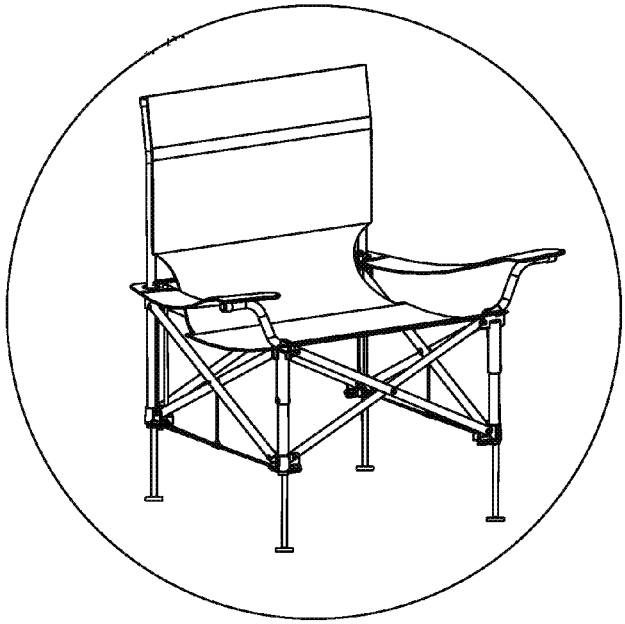

With reference now to FIG. 8, which illustrates a next following period during the movement of the left hand cable extent 182L, it can be seen that the continued upward motion of the strap 180 exerts a pulling force on the left hand cable extent 182L such that the release pin 146*a* is fully retracted from the through bore 178 of the telescoping post 138*a* and the stop shoulder 174*a* in combination with the full compression of the spring 168*a* prevents the release pin 146*a* from being in the retraction direction. The continued exertion of the pulling tension on the release pin 146*b* after the full retraction of the release pin 146*a* results in the retraction of the release pin 146*b* from its respective seated disposition in the respective through bore 178 of the telescoping posts 138*b*. Thus, it can be understood that, after the completion of the next following period of movement illustrated in FIG. 8, both the telescoping post 138*a* and the telescoping post 138*b* are now released from their respective fixed securements to the 136*a*, 136*b*, respectively, and the chair user now positions the chair 112 on the terrain location 114. During this positioning, the chair user continues to maintain the strap 180 in its raised disposition relative to the top of the folding chair and the chair user makes a determination as the chair user positions the folding chair as to whether the seating surface 122 appears to be so positioned that the seating plane 124 delimited by the seating surface 122 appears to be generally parallel to the horizontal plane 118. It can be understood that, during this visual determination process performed by the chair user, the telescoping posts 138*a*, 138*b* extend or retract relative to their respective nesting portion 134*a*, 134*b* as a result of respective raising or lowering movements of the seating surface 122 that occur as the chair user adjusts the height of the folding chair 112. The force of gravity acting downwardly on the telescoping post 138*a*, 138*b* causes the respective foot base 140*a*, 140*b* to extend downwardly to an extent that the respective foot base rests upon the terrain location 114. In the event, for example, that the telescoping post 138*a* comes to rest on the raised portion 116 of the terrain location 114 and the telescoping posts 138*d* comes to rest on the lower portion 120 of the terrain location 114, the telescoping post 138*a* will be relatively further retracted into its associated nesting portion 134*a* then the telescoping post 138*b* will be retracted into its associated nesting portion 134*b*.

Figure 9:
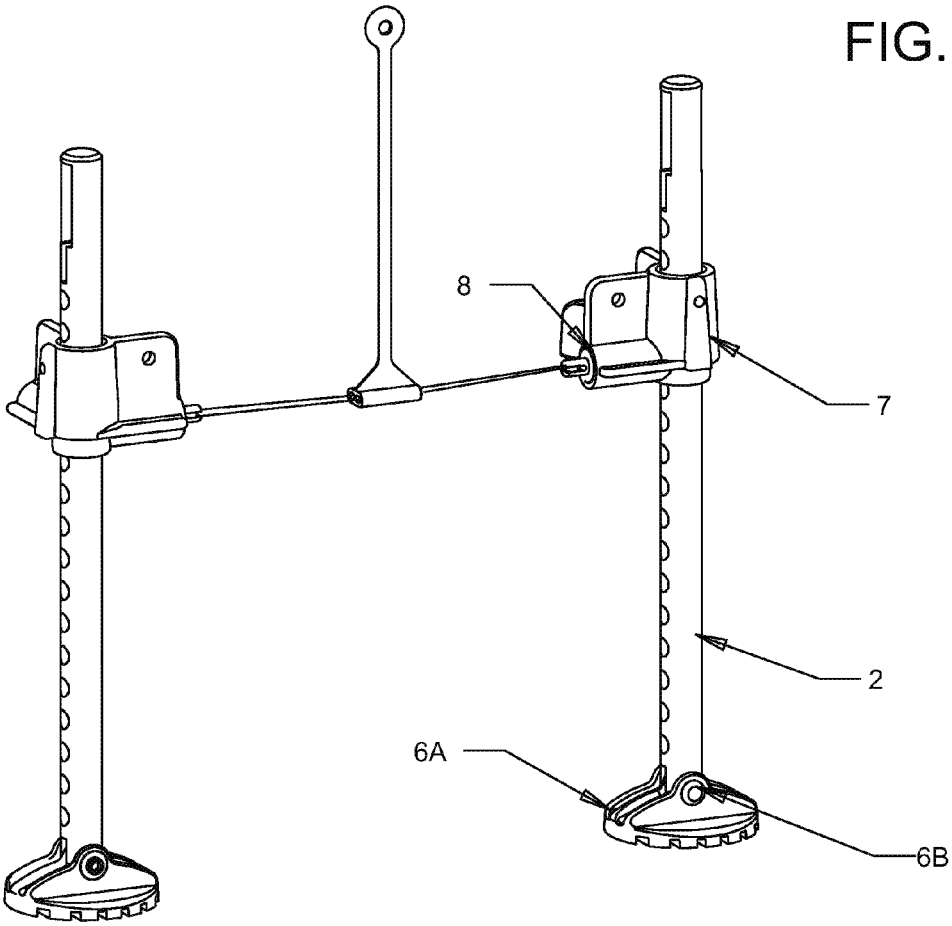
FIG. 9 is a perspective view of the first adjustment structure and the second adjustment structure of the folding chair shown in FIG. 1 and showing the switch over element in its down select disposition after completing its staging disposition as illustrated in FIGS. 7 and 8.

With reference now to FIG. 9, which illustrates the positions of the release pin 146*a* and the release pin 146*b* after the switchover element 154 has been disposed for its staging disposition into its stop set disposition, it can be seen that the chair user has now returned the strap 180, or released the strap 180 to return to, its initial non-raised position (as illustrated in FIG. 6). In its movement from its staging disposition to its stop set disposition, the switchover element 154 effects respective movements of the first adjustment structure 128 and the second adjustment structure 148 such that each respective adjustment structure moves from its respective adjusting movement disposition to its stop set disposition. Specifically, the return of the strap 180 to its initial non-raised position causes the left hand cable extent 182L to move in training movements around the change of direction roller 184L and 186L as well as to move in a training direction around the change of direction roller 164*a* of the release pin 146*a*. As the left hand cable extent 182L now exerts relatively less tension on the release pin 146*a*, the release pin 146*a* is urged via the inherent bias force of the spring 168*a* to extend into the respective through bore 178 in the telescoping post 138*a*. Also, the reduced pulling tension of the left hand cable extension 182L permits the spring 168*b* to exert a biasing force on the release pin 146*b* such that the release pin 146*b* is extended into the respective through bore 178*a* that it is in alignment with the release pin (the through bore 178 on the telescoping post 138*b*). The telescoping posts 138*a-d* are now again fixedly secured to the respective adjustment blocks 144*a-d*, whereupon the folding chair 112 is reliably and stably secured in a disposition on the terrain location 114 with the seating surface 122 advantageously disposed at a generally horizontal disposition. The chair user can now sit in the folding chair 112 and enjoy a comfortable seating posture in spite of the fact that the folding chair 112 is disposed on uneven terrain.

Figure 13:
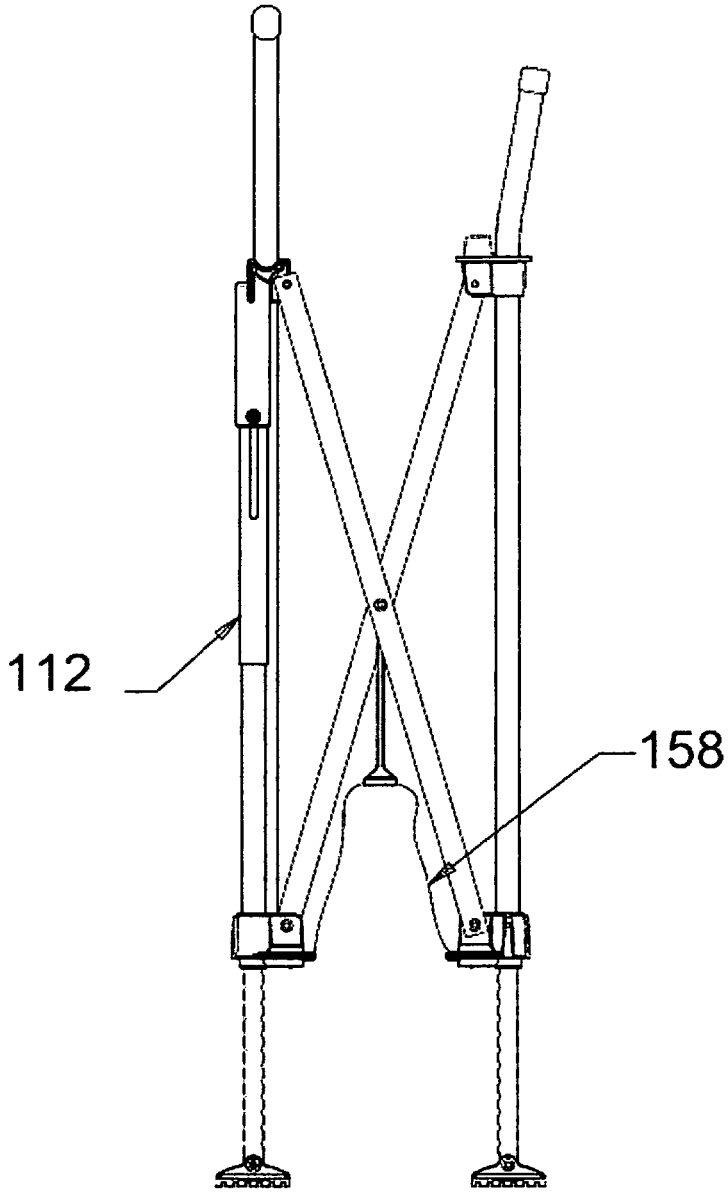
FIG. 13 is a side elevational view of the left hand side of the folding chair showing the folding chair in its folded condition.

With reference to FIG. 13, which is a side elevational view of the left hand side of the folding chair showing the folding chair in its folded condition, it can be understood that the switch over element 154 is configured such that the switch over element permits the folding chair 112 to be folded and unfolded between an unfolded position in which the first adjustment system 128, the second adjustment system 148, the third adjustment system 160, and the fourth adjustment system 162 are at respective lateral spacings from one another, as viewed parallel to the seating plane 124, and a folded position in which the first adjustment system 128, the second adjustment system 148, the third adjustment system 160, and the fourth adjustment system 162 are at different respective lateral spacings from one another, as viewed parallel to the seating plane 124, that are less than the respective lateral spacings from one another of the first adjustment system 128, the second adjustment system 148, the third adjustment system 160, and the fourth adjustment system 162 in the unfolded position of the folding chair 112. This beneficial flexibility of the switch over element 154 is achieved via the deployment of the left hand cable extent 182L and the right hand cable extent 1828, each of which flexibly assumes a cooperative configuration during folding and unfolding of the folding chair 112.

It can be understood that the switch over element 154 is configured such that a predetermined actuation of the switch over element disposes the switch over element in its staging disposition and this predetermined actuation of the switch over element is operable to effect both the respective movement of the first adjustment system 128 from its stop set disposition to its telescoping movement disposition and the respective movement of the second adjustment system 148 from its stop set disposition to its telescoping movement disposition. In the context of the present invention, a "predetermined actuation of the switch over element" operable to effect both the respective movement of the first adjustment system 128 from its stop set disposition to its telescoping movement disposition and the respective movement of the second adjustment system 148 from its stop set disposition to its telescoping movement disposition is to be understood to comprise a range of actuation operations that are adapted for the respective configuration of the switch over element of the article. For example, the "predetermined actuation of the switch over element" may, in a given configuration of the switch over element, include a series of operations of a component of the chair initiated by a chair user at a single location on the chair while the "predetermined actuation of the switch over element" may, in another given configuration of the switch over element, include a single operation or multiple operations of one component of the chair as well as a single operation or multiple operations of a different component of the chair, with the respective operations of the one component of the chair and the different component of the chair being initiated in each instance by a single hand of a chair user or being initiated by two hands of a chair user. Additionally, a respective operation of a component of the chair initiated by a chair user may be conducted at the same time as a respective operation of another component of the chair or before or after a respective operation of another component of the chair at a randomly occurring time or at a predetermined time.

It has been shown and described herein that the switch over element 154 is configured such that a "down select" predetermined actuation of the switch over element that disposes the switch over element in its down select disposition is operable to effect both a respective movement of the first adjustment system 128 out of its telescoping movement disposition into readiness to assume its stop set disposition and a respective movement of the second adjustment system 148 out of its telescoping movement disposition into readiness to assume its stop set disposition. In the context of the present invention, a "'down select' predetermined actuation of the switch over element" operable to effect both a respective movement of the first adjustment system out of its telescoping movement disposition into readiness to assume its stop set disposition and a respective movement of the second adjustment system out of its telescoping movement disposition into readiness to assume its stop set disposition is to be understood to comprise a range of actuation operations that are adapted for the respective configuration of the switch over element of the article. For example, the "down select predetermined actuation of the switch over element" may, in a given configuration of the switch over element, include a series of operations of a component of the chair initiated by a chair user at a single location on the chair while the "down select predetermined actuation of the switch over element" may, in another given configuration of the switch over element, include a single operation or multiple operations of one component of the chair as well as a single operation or multiple operations of a different component of the chair, with the respective operations of the one component of the chair and the different component of the chair being initiated in each instance by a single hand of a chair user or being initiated by two hands of a chair user. Additionally, a respective operation of a component of the chair initiated by a chair user may be conducted at the same time as a respective operation of another component of the chair or before or after a respective operation of another component of the chair at a randomly occurring time or at a predetermined time. One subordinate category of the operations of a component of the chair initiated by a chair user in association with a "down select predetermined actuation of the switch over element" is a category of certain operations of a component of the chair initiated by a chair user that effect respective movements of two or more of the first adjustment system, the second adjustment system, the third adjustment system, or the fourth adjustment system out of its respective telescoping movement disposition into readiness to assume its respective stop set disposition, wherein the certain operation of a component of a chair initiated by a chair user in this connection could involve a single operation of the switch over element to effect all of the respective movements of two or more of the first adjustment system, the second adjustment system, the third adjustment system, or the fourth adjustment system out of its respective telescoping movement disposition into readiness to assume its respective stop set disposition, multiple operations of the switch over element at the same region of the chair to effect respective movements of two or more of the first adjustment system, the second adjustment system, the third adjustment system, or the fourth adjustment system out of its respective telescoping movement disposition into readiness to assume its respective stop set disposition, or an operation of one component of the switch over element at one region of the chair together with an operation of a different component of the switch over element at a different region of the chair to effect respective movements of two or more of the first adjustment system, the second adjustment system, the third adjustment system, or the fourth adjustment system out of its respective telescoping movement disposition into readiness to assume its respective stop set disposition.

A category of certain operations of a component of the chair initiated by a chair user includes an operation of one component of the switch over element at one region of the chair initiated by a chair user to effect respective movements of two or more of the first adjustment system, the second adjustment system, the third adjustment system, or the fourth adjustment system out of its respective telescoping movement disposition into readiness to assume its respective stop set disposition. Another category of certain operations of a component of the chair initiated by a chair user includes an operation of one component of the switch over element at one region of the chair initiated by one hand of a chair user and an operation of a different component of the switch over element at a different region of the chair initiated by another hand of a chair user, the two hand operations being performed at the same time or at different times, to effect respective movements of two or more of the first adjustment system, the second adjustment system, the third adjustment system, or the fourth adjustment system out of its respective telescoping movement disposition into readiness to assume its respective stop set disposition.

A variation of those categories of certain operations of a component of the chair initiated by a chair user, including both of the two categories of certain operations of a component of the chair initiated by a chair user noted immediately above herein, includes an operation of one component of the switch over element initiated by a chair user to effect respective movements of three or more of the first adjustment system, the second adjustment system, the third adjustment system, or the fourth adjustment system out of its respective telescoping movement disposition into readiness to assume its respective stop set disposition. For example, as shown and described herein with respect to the operation of the switch over element 154, an operation of one component of the switch over element 154—namely, an operation of raising the strap 180 relative to the top of the folding chair 112, operates to effect respective movements of all four of the first adjustment system 128, the second adjustment system 148, the third adjustment system 160, and the fourth adjustment system 162 out of their respective telescoping movement dispositions into readiness to assume their respective stop set dispositions.

It can be understood that the switch over element 154 is configured such that a predetermined actuation of the switch over element that disposes the switch over element in its staging disposition is operable to effect both the respective movement of the first adjustment system 128 from its stop set disposition to its telescoping movement disposition and the respective movement of the second adjustment system 148 from its stop set disposition to its telescoping movement disposition and, as well, the switch over element 154 is configured such that a "down select" predetermined actuation of the switch over element that disposes the switch over element in its down select disposition is operable to effect both a respective movement of the first adjustment system 128 out of its telescoping movement disposition into readiness to assume its stop set disposition and a respective movement of the second adjustment system 148 out of its telescoping movement disposition into readiness to assume its stop set disposition. Moreover, it can be understood that the switch over element 154 is configured such that a predetermined actuation of the switch over element that disposes the switch over element in its staging disposition is operable to effect both the respective movements of all four of the first adjustment system 128, the second adjustment system 148, the third adjustment system 160, and the fourth adjustment system 162 out of their respective stop set dispositions to their respective telescoping movement dispositions and, as well, the switch over element 154 is configured such that a "down select" predetermined actuation of the switch over element that disposes the switch over element in its down select disposition is operable to effect all four of the first adjustment system 128, the second adjustment system 148, the third adjustment system 160, and the fourth adjustment system 162 out of their respective telescoping movement dispositions into readiness to assume their respective stop set dispositions.

With reference now to FIGS. 10*a-k*, an exemplary embodiment of the present invention in the form of an adjustable height chair is illustrated, the chair having legs that disengage simultaneously and then reengage with the pull of a handle. The chair has a handle 11 which, when pulled, simultaneously releases all legs so that they may be adjusted to various heights depending upon the contour of a given slope or terrain. By pulling a handle located on the back of the chair all legs are simultaneously disengaged from the current position, freed up to assume another position, and then reengaged when the handle is released. A release pin 1 used to sit in a hole and maintain chair height. The release pin 1 can be pulled out to readjust chair leg height and then reseated. It can also be square, hexagon or any other geometric shape. It is typically made of 4140 steel alloy, but can also be made of plastic, wood, or any other type of steel. The release pin 1 is typically 2.25 inches long, but can be as short as, but not limited to, one inch to twelve inches or longer.

An adjustable leg 2 contains round but not limited to round holes into which the release pin 1 sits to maintain the chair 20 height. The leg 2 can be made of any type of plastic, aluminum or other steel, but is not limited to these materials. It is typically made of 6061 aluminum. The adjustable portion of leg 2 is preferably but not necessarily 11.3 inches long. The leg 2 can be two inches to, but not limited to, two feet long. The leg 2 contains but is not limited to 17 holes. The adjustable portion of leg 2 has a guide track or groove that is typically but not limited to 10.08 inches long making it easier to slide in and out of the nesting portion of leg 2.

The front right joint 3 is used to join three front right tubes together and provides support for the armrest. Typically the joint 3 is made of polypropylene, but can be made of, for example, any aluminum or steel. A typical size for the joint 3 is 2.3 inches by 2.125 inches, but it can be 1 inch by 3 inches or more.

The foot base 6*a* is used to provide secure traction on the ground while the chair is in use. The foot base 6*a* is typically made of 6061 aluminum but can be made of any other aluminum or steel or plastic. The foot base 6*a* is typically round but could be any other geometric shape. The foot base 6*a* is preferably but not necessarily about 1 inch to 6 inches in diameter but preferably 3 inches.

The front block 5 provides support for front chair posts when the chair is being used. The front block 5 is typically made of polypropylene but can be made of but not limited to any aluminum or steel. The front block 5 is typically but not necessarily about 4 inches long and 3 inches deep. It can be more squarely shaped.

The front left joint 4 is identical in purpose, size and function to the front right joint 3 except used on the left side.

The adjustment block 7, connected to bottom of upper portion of leg, houses the release pin 1 and adjustable portion of leg 2 and allows for the adjustable portion of leg 2 to be moved up and down inside the upper portion of leg and for the release pin 1 to be seated into one of several holes in the leg 2. The adjustment block 7 is typically round but can be any other geometric shape. The adjustment block 7 is typically made of 6061 aluminum but can be made of any aluminum, plastic or steel. The adjustment block 7 is typically but not necessarily 1 inch high by 1 inch in diameter but more preferably 1.7 inches high by approximately 3 inches in diameter.

The pin assembly 8 allows for the pull and release of the release pin 1 in and out of a leg hole in order to adjust the height of chair. The pin assembly 8 contains a pin 1, spring-coil 8*a*, spacer 8*b* and set-screw 8*c*. The pin assembly 8 is typically made of aluminum and steel but some can be made of plastic.

The chair legs 2 with holes pass through the adjustment block 7 and into or out of the nesting portion of the leg. The pin assembly 8 runs through one side of the adjustment block 7 and is held in place in a particular hole by use of a coil 8*a* and a C-ring. Both front joints 3 and 4 provide support and give the front legs 2 a nesting place when the chair is open. The front block 5 provides support to the tubing and allows the chair to fold up.

The adjustable leg assembly 9 comprises the pin assembly 8, the adjustment block 7, the adjustable portion of leg 2, and the foot base assembly 6 (FIG. 9).

The cloth handle 11 is behind the chair. A cable 12 such as fishing line or any other suitable material is run from either end of the handle 11, down the rear legs, through both the rear adjustment blocks 7 on both the left and right side. The cable 12 is run through the rear adjustment blocks 7 toward the front two pin assemblies 8, through the pin assemblies 8 and back toward and through the two rear pin assemblies 8. When the handle 11 is pulled, the cable 12 tightens and pulls the pins 1 out and away from the leg hole they were previously seated in. The legs 2 are then adjusted to desired height and, when the handle 11 is released, the pins 1 reseat themselves into the appropriate leg hole.

To make an exemplary embodiment of the device, the adjustment blocks 7 are attached to a modified camping chair. Adjustable legs 2 are run through the adjustment block 7 and telescope into upper portion of chair leg. Pin assemblies 8 are held in place with C-rings in the adjustment block 7 to allow for the chair leg 2 to be moved up or down and then held in a given position. A cable 12 is then threaded through the pins 1 and connected to a handle located on the back of the chair.

To use the device, the person first grabs the handle 11 with four fingers and loops his thumb over the back strap loop 10. Using the other hand to grab the front arm of the chair to stabilize the chair, the person pulls up on the handle 11. The cable 12 is made taut and pulls out the pins 1 releasing the legs 2. The person holds the chair firmly as the legs 2 are loose, positions the chair to the desired height and then releases the handle 11.

The chair will typically have four legs 2, but designs with more or less legs 2 can be used.

These elements can be reconfigured to perform similar functions on a variety of camping equipment such as cots, coffee or end tables, kitchen tables, picnic tables, or grills. This approach can be used wherever an adjustable setting is required for a table, desk, workbench, chair or any other piece of furniture. The material used in this particular embodiment is aimed at the camping industry, but because of its ease of use wherever there is a need to quickly and easily adjust a table, chair, workbench or grill, the approach can be used assuming the appropriate materials are used to guarantee safety.

The article of the present invention has been exemplarily disclosed and illustrated with respect to a folding chair but it is to be understood that the article can as well be any structure in which it is desirable or advantageous to have the capability of simultaneous and independent adjustment of two or more limbs or extremities of the article. For example, the article could be of a structure comprising two or more limbs or extremities and deployed in a circumstance in which it is desirable to adjustably position the limbs or extremities at varying extents from a recipient portion of the article. For example, the limbs of the article could be extended horizontally to contact and engage vertical surfaces at respective different spacings from the recipient portion of the article. Additionally, the article has been described herein as comprising a switchover element operable between a staging disposition and a down select disposition, wherein the switchover element is configured with a cable sub-assembly. However, it is to be understood that the switchover element could as well comprise any electrical, mechanical, chemical, or other mechanism that is operable to be disposed between a staging disposition and a down select disposition.

From the foregoing description of one embodiment of the invention, it will be apparent that many modifications may be made therein. It will be understood that this embodiment of the invention is an exemplification of the invention only and that the invention is not limited thereto.

What is claimed is:

1. A chair comprising:

a person support structure on which a person can be supported, the person support structure including a seating portion on which a person can assume a seated disposition, the seating portion delimiting a seating plane;

a first adjustment system including a first telescoping post and a first inter-stop element and including a first nesting portion, the first nesting portion and the first telescoping post together forming a first leg whose length is lengthened or shortened via movement of the first telescoping post relative to the first nesting portion;

a second adjustment system including a second telescoping post and a second inter-stop element and including a second nesting portion, the second nesting portion and the second telescoping post together forming a second leg whose length is lengthened or shortened via movement of the second telescoping post relative to the second nesting portion, each of the first adjustment system and the second adjustment system being connected to the person support structure, the first adjustment system being disposable between a telescoping movement disposition and a stop set disposition with the first telescoping post and the first inter-stop element being movable relative to one another in the telescoping movement disposition and relative movement between the first telescoping post and the first inter-stop element being resisted when the first telescoping post and the first inter-stop element are in the stop set disposition, and the second adjustment system being disposable between a telescoping movement disposition and a stop set disposition with the second telescoping post and the second inter-stop element being movable relative to one another in the telescoping movement disposition and relative movement between the second telescoping post and the second inter-stop element being resisted when the second telescoping post and the second inter-stop element are in the stop set disposition; and a switch over element, the switch over element being disposable between a staging disposition and a down select disposition, the switch over element being operatively connected to the first adjustment system and the second adjustment system such that disposing the switch over element in its staging disposition effects a respective movement of the first adjustment system from its stop set disposition to its telescoping movement disposition and a respective movement of the second adjustment system from its stop set disposition to its telescoping movement disposition and disposing the switch over element in its down select disposition effects a respective movement of the first adjustment system out of its telescoping movement disposition into readiness to assume its stop set disposition and a respective movement of the second adjustment system out of its telescoping movement disposition into readiness to assume its stop set disposition and the switch over element being configured such that a predetermined actuation of the switch over element disposes the switch over element in its staging disposition and this predetermined actuation of the switch over element is operable to effect both the respective movement of the first adjustment system from its stop set disposition to its telescoping movement disposition and the respective movement of the second adjustment system from its stop set disposition to its telescoping movement disposition, the first adjustment structure and the second adjustment structure contributing in supporting the seating portion at a spacing above a surface, the first telescoping post being movable relative to the first nesting portion to lengthen the first leg or to shorten the first leg and the first telescoping post being engageable by the first inter-stop element at a respective engagement location along its extent that comes into registry with the first inter-stop element after the first telescoping post has moved telescopically outwardly relative to the first nesting portion to lengthen the first leg or has moved telescopically inwardly relative to the first nesting portion to shorten the first leg, whereupon the telescoping movements of the first telescoping post relative to the first nesting portion and the engagement of the first telescoping post at the various engagement locations by the first inter-stop element operate to vary a height at which the first adjustment structure supports the seating portion above a surface, and the second telescoping post being movable relative to the second nesting portion to lengthen the second leg or to shorten the second leg and the second telescoping post being engageable by the second inter-stop element at a respective engagement location along its extent that comes into registry with the second inter-stop element after the second telescoping post has moved telescopically outwardly relative to the second nesting portion to lengthen the second leg or has moved telescopically inwardly relative to the second nesting portion to shorten the second leg. whereupon the telescoping movements of the second telescoping post relative to the second nesting portion and the engagement of the second telescoping post at the various engagement locations by the second inter-stop element operate to vary a height at which the second adjustment structure supports the seating portion above a surface and the chair being disposable between an unfolded position in which the first adjustment system and the second adjustment system are at a lateral spacing from one another, as viewed parallel to the seating plane, and a folded position in which the first adjustment system and the second adjustment system are at a different lateral spacing from one another, as viewed parallel to the seating plane, that is less than the lateral spacing of the first adjustment system and the second adjustment system from one another in the unfolded position of the chair.

2. A chair according to claim 1, and further comprising a biasing arrangement that biases the first adjustment system and the second adjustment system to each automatically move into its respective stop set disposition after (a) the switch over element in its down select disposition has effected a respective movement of the first adjustment system out of its telescoping movement disposition into readiness to assume its stop set disposition and a respective movement of the second adjustment system out of its telescoping movement disposition into readiness to assume its stop set disposition and (b) a predetermined respective alignment of the first telescoping post and the first inter-stop element with one another and a predetermined respective alignment of the second telescoping post and the second inter-stop element with one another have occurred.

3. A chair according to claim 2, wherein, in the stop set disposition of the first adjustment structure, the first inter-stop element is operable to engage the first telescoping post at a first set stop location that is at a fixed spacing from the person support structure such that the first inter-stop element and the first telescoping post are releasably secured to one another at the first stop set location and, in the telescoping movement disposition, the first inter-stop element is operable to disengage from the first telescoping post to thereby permit movement of the first telescoping post relative to the first set stop location and, after the first telescoping post has subsequently telescoped outwardly or inwardly relative to the first nesting portion, the first inter-stop element is operable to subsequently re-engage the first telescoping post at the first set stop location with the first set stop location remaining at the same fixed spacing from the person support structure during both the initial engagement of the first inter-stop element with the first telescoping post and the re-engagement of the first inter-stop element with the first telescoping post and, in the stop set disposition of the second adjustment structure, the second inter-stop element is operable to engage the second telescoping post at a second set stop location that is at a fixed spacing from the object support portion such that the second inter-stop element and the second telescoping post are releasably secured to one another at the second stop set location and, in the telescoping movement disposition, the second inter-stop element is operable to disengage from the second telescoping post to thereby permit movement of the second telescoping post relative to the second set stop location and, after the second telescoping post has subsequently telescoped outwardly or inwardly relative to the second nesting portion, the second inter- stop element is operable to subsequently re-engage the second telescoping post at the second set stop location with the second set stop location remaining at the same fixed spacing from the person support structure during both the initial engagement of the second inter-stop element with the second telescoping post and the re-engagement of the second inter-stop element with the second telescoping post.

4. A chair according to claim 3, wherein the switch over element includes a cable that engages the first inter-stop element and the second inter-stop element.

5. A chair according to claim 4, wherein the first adjustment structure includes a first nesting portion, the first telescoping post and the first nesting portion are operatively interconnected to one another such that the first telescoping post can move relative to the first nesting portion, the first inter-stop element includes a first pin component that is movable supported by the first nesting portion and engaged by the cable of the switch over element, the switch over element is operable to effect movement of the first pin component between a pin engagement position in which the first pin component engages the first telescoping post and a pin disengage position in which the first pin component is disengaged from the first telescoping post, the second adjustment structure includes a second nesting portion, the second telescoping post and the second nesting portion are operatively interconnected to one another such that the second telescoping post can move relative to the second nesting portion, the second inter-stop element includes a second pin component that is movable supported by the second nesting portion and engaged by the cable of the switch over element, and the switch over element is operable to effect movement of the second pin component between a pin engagement position in which the second pin component engages the second telescoping post and a pin disengage position in which the second pin component is disengaged from the second telescoping post.

6. A chair according to claim 5, wherein the first pin component is biased towards its pin engagement position and the second pin component is biased towards its pin engagement position in which the first pin component is disengaged from the first telescoping post, and the cable of the switch over element is movable to effect movement of the first pin component and the second pin component in a direction from its respective pin engagement position towards its pin disengagement position against the bias towards its pin engagement position.

* * * * *